US006076308A

United States Patent [19]

Lyon et al.

[11] Patent Number: 6,076,308

[45] **Date of Patent: *Jun. 20, 2000**

[54] PARTITION PANEL SYSTEM WITH ADJUSTABLE OVERHEAD STORAGE

[75] Inventors: LaDene S. Lyon, Wayland; Joylene M. Battey, Kentwood, both of Mich.; Kurt P. Dammerman, San Francisco, Calif.; Michelle L. Lindale, Muskegon; Anthony A. Stachowiak, Belmont, both of Mich.

[73] Assignee: Steelcase Development Inc., Grand Rapids, Mich.

[ * ] Notice: This patent is subject to a terminal disclaimer.

[21] Appl. No.: 09/015,047

[22] Filed: Jan. 28, 1998

Related U.S. Application Data

[63] Continuation-in-part of application No. 08/701,664, Aug. 22, 1996, Pat. No. 5,890,325, which is a continuation-in-part of application No. 08/687,724, Jul. 26, 1996, Pat. No. 5,816,001, which is a continuation-in-part of application No. 08/579,614, Dec. 26, 1995, Pat. No. 5,746,035.

[51] Int. Cl.[7] ..... E04B 2/74

[52] U.S. Cl. ..... 52/36.6; 52/36.1; 52/239

[58] Field of Search ..... 52/36.1, 36.6, 52/239

[56] References Cited

U.S. PATENT DOCUMENTS

| | | | |
|---|---|---|---|
| 2,657,811 | 11/1953 | Isler . | |
| 3,174,592 | 3/1965 | Berman et al. | 52/36.6 X |
| 3,425,568 | 2/1969 | Albright . | |
| 3,502,293 | 3/1970 | Bard . | |
| 3,514,883 | 6/1970 | Albright . | |

(List continued on next page.)

OTHER PUBLICATIONS

Exhibit A is a brochure entitled *Knoll—Hannah Desk System*, 18 pages, dated Oct. 1986.

Exhibit B is a brochure entitled *Knoll—Hannah Desk System*, 13 pages, undated but published in 1986.

Exhibit C is a publication entitled *Knoll—Hannah Desk System—Electrical Assembly Guide,* (12 pages), undated but published in 1986.

Exhibit D is a publication entitled *Knoll—Hannah Desk System—Assembly Guide,* 12 pages, undated but published in 1986.

Exhibit B discloses a prior art bracket arrangement, installed in a public location by Steelcase more than 1 year prior to filing the present application.

*Primary Examiner*—Christopher T. Kent

*Attorney, Agent, or Firm*—Price, Heneveld, Cooper, DeWitt & Litton

[57] ABSTRACT

A partition panel system including a partition frame with vertically spaced horizontal frame members defining first discrete attachment locations, a pair of horizontally spaced blades adjustably attached to selected ones of the first discrete attachment locations, the blades including opposing inner surfaces defining vertically spaced second discrete attachment locations, and shelves adjustably attached to selected ones of the second discrete attachment locations. This allows the shelves to be horizontally and vertically adjustably supported on the partition frame in a selected one of a variety of positions. At least one shelf has a front portion with edges that extend partially around in front of the blades, thus providing increased surface area. The shelves are supported on the blades by shelf supports. Connectors on the ends of the shelves are movable between engaged and disengaged positions for securely engaging the shelf supports. Antidislodgement brackets are provided on the blades that are movable between locked and unlocked positions, the antidislodgement brackets when in the locked position securing the blades to the horizontal frame members. In one form, the blades and shelf form an assembly comprising a binder bin, which includes a closeable door guided by tracks attached to sides of the binder bin.

69 Claims, 23 Drawing Sheets

U.S. PATENT DOCUMENTS 3,614,044 10/1971 Bard .
3,641,950 2/1972 Axhamre .
3,679,164 7/1972 Bard .
3,771,847 11/1973 Aylworth .
3,810,430 5/1974 Siegal .
4,018,019 4/1977 Raith et al. .
4,120,124 10/1978 Temple et al. .
4,123,879 11/1978 Blodee et al. .
4,265,502 5/1981 Blodee et al. .
4,569,163 2/1986 Long .
4,619,486 10/1986 Hannah et al. .
4,685,255 8/1987 Kelley .
4,688,750 8/1987 Teague et al. .
4,716,692 1/1988 Harper et al. .
4,722,285 2/1988 Goodman .
4,733,841 3/1988 Wilson .
4,883,330 11/1989 Armstrong et al. .
4,884,375 12/1989 Wendt .
4,944,122 7/1990 Wendt .
5,038,539 8/1991 Kelley et al. .
5,074,422 12/1991 Holtz .
5,172,529 12/1992 Van De Riet .
5,172,530 12/1992 Fishel et al. .
5,212,915 5/1993 Antonio .
5,255,478 10/1993 Baranowski et al. .
5,301,477 4/1994 Rellinger et al. .
5,373,793 12/1994 Crossman .
5,881,500 3/1999 Latino et al. ..... 52/36.1
5,890,325 4/1999 Corcorran et al. ..... 52/36.1

PARTITION PANEL SYSTEM WITH ADJUSTABLE OVERHEAD STORAGE

CROSS REFERENCE TO RELATED APPLICATIONS

This is a continuation-in-part of coassigned application Ser. No. 08/701,664, filed Aug. 22, 1996, U.S. Pat. No. 5,890,325 entitled RECONFIGURABLE SYSTEM FOR SUBDIVIDING BUILDING SPACE AND HAVING MINIMAL FOOTPRINT, the entire contents of which are incorporated herein, which is a continuation-in-part of application Ser. No. 08/687,724, filed Jul. 26, 1996, U.S. Pat. No. 5,816,001 entitled PARTITION CONSTRUCTION INCLUDING INTERCONNECTION SYSTEM AND REMOVABLE COVERS, which is a continuation-in-part of application Ser. No. 08/579,614, filed Dec. 26, 1995, U.S. Pat. No. 5,746,035 entitled PARTITION SYSTEM, the entire contents of both of which are incorporated herein in their entireties by reference.

BACKGROUND OF THE INVENTION

The present partition system concerns overhead storage units adjustably attached to a partition, and more particularly concerns blades and shelves each adjustably but securely attached to provide flexibility in location and use.

Partition systems may include provisions for support of binder bins, shelves, and other overhead storage units for use in office arrangements. However, existing bins and shelves lack the adjustability required to position the overhead storage units in locations for optimal use given the specialized needs of particular users of the office arrangements. Secure attachment is also desired so that, despite the adjustability, the overhead storage units are stable and feel secure on the partition systems. Concurrently, an attachment system is desired that is mechanically simple, and that does not require a myriad of different parts and pieces, particularly loose parts and pieces that are easily lost and that require significant manual labor to install. Also, an attachment system is desired that is adapted to compensate for dimensional variations and tolerance stack-ups in the overall system.

SUMMARY OF INVENTION

The present invention includes a partition panel system including a partition frame with vertically spaced horizontal frame members defining a horizontal row of first discrete attachment locations. The panel system also includes a pair of horizontally-spaced blades that are releasably attached to selected ones of the first discrete attachment locations. The blades include opposing inner surfaces defining vertically-spaced second discrete attachment locations. At least one shelf is releasably attached to selected ones of the second discrete attachment locations such that the shelf is horizontally and vertically adjustably supported on the partition frame in a selected one of a variety of different discrete positions.

The present invention further includes a partition panel system including a partition panel and a pair of horizontally spaced-apart upright blades defining front edges away from the partition panel. The blades are attached to a front of the partition panel. A plurality of shelves, each defining side edges, are attached between the blades. At least one of the shelves has a front portion with side edges that extend partially around the front edges of the blades.

The present invention still further includes a partition panel system including a partition panel and a pair of horizontally-spaced blades attached to a front of the partition panel. The horizontally-spaced blades define opposing inner surfaces. The partition panel system also includes shelf inner supports on the opposing inner surfaces of the blades. The partition panel further includes a shelf with ends configured to engage the shelf inner supports and shelf locks on the ends of the shelf that are movable between locked and unlocked positions. When the locks are in the locked position, the shelf is secured to the shelf supports to prevent the shelf supports from being dislodged from the blades.

The present invention still further includes a partition panel having vertically spaced-apart horizontal frame members defining horizontally-spaced discrete attachment locations. A pair of horizontally spaced-apart blades having upper and lower ends configured to securely engage the vertically spaced-apart horizontal frame members of the partition panel at selected ones of the horizontally-spaced discrete attachment locations. At least one of the upper and lower ends of the blades is vertically adjustable relative to the other of the upper and lower ends. A shelf is attached between the blades. The blades have antidislodgement brackets that are movable between locked and unlocked positions and secure the blades to the horizontal frame members when in the locked position. The blades and shelf are attachable to the partition panel in a selected location optimally suited for particular circumstances of use.

The present invention also includes a partition panel system including a partition panel and a binder bin configured for attachment to the partition panel. The binder bin includes opposing side walls with inner surfaces, with top and bottom walls extending between the side walls to define an enclosable cavity with an opening. The binder bin also includes opposing molded track members attached to the inner surfaces of the opposing side walls. The track members each define a pair of integrally-formed guides. The binder bin also includes a door with a bottom edge and opposite ends. Each of the opposite ends include a pair of guide-engaging members. Each of the guide-engaging members slidably engage one of the guides. The guides are configured to guide the opening and closing of the door so that when the door is opened a bottom of the door pivots initially outwardly and upwardly, and then the door slides under the top panel.

The invention further includes a partition panel system for offices and the like including at least two substantially planar partition panels defining orthogonal front surfaces. The panels are joined along a vertical junction. A vertically elongated corner support member is aligned with, and adjacent to, the vertical junction. The support member is attached to at least one of the partition panels, and has a tubular cross-sectional shape with a front face and a rear face. The front face has a first vertical row of slots, and the rear face has a second vertical row of slots. The partition panel system also includes a corner shelf with at least two substantially straight rear edge portions that are orthogonal to one another and configured to align with the orthogonal front surfaces of the partition panels in close proximity thereto. The corner shelf includes a support member adjacent the rear edge with an extension engaging a selected one of the slots in the front face and also engaging a selected one of the slots in the rear face to removably support the corner shelf on the partition panel system.

The invention also includes a partition panel system for offices and the like including at least two substantially planar partition panels defining orthogonal front surfaces. The panels are joined at a vertical junction and include a partition frame with vertically spaced-apart horizontal members defining horizontally-spaced first discrete attachment locations. The partition panel system also includes a pair of horizontally-spaced blades that are releasably attached to selected ones of the first discrete attachment locations. The blades define opposing inner surfaces. The opposite ends of the corner shelf are releasably attached to the opposing inner surfaces of the blades.

These and other features and advantages of the present invention will be further understood and appreciated by those skilled in the art by reference to the following specification, claims, and appended drawings.

DETAILED DESCRIPTION OF PREFERRED EMBODIMENTS

Figure 1:
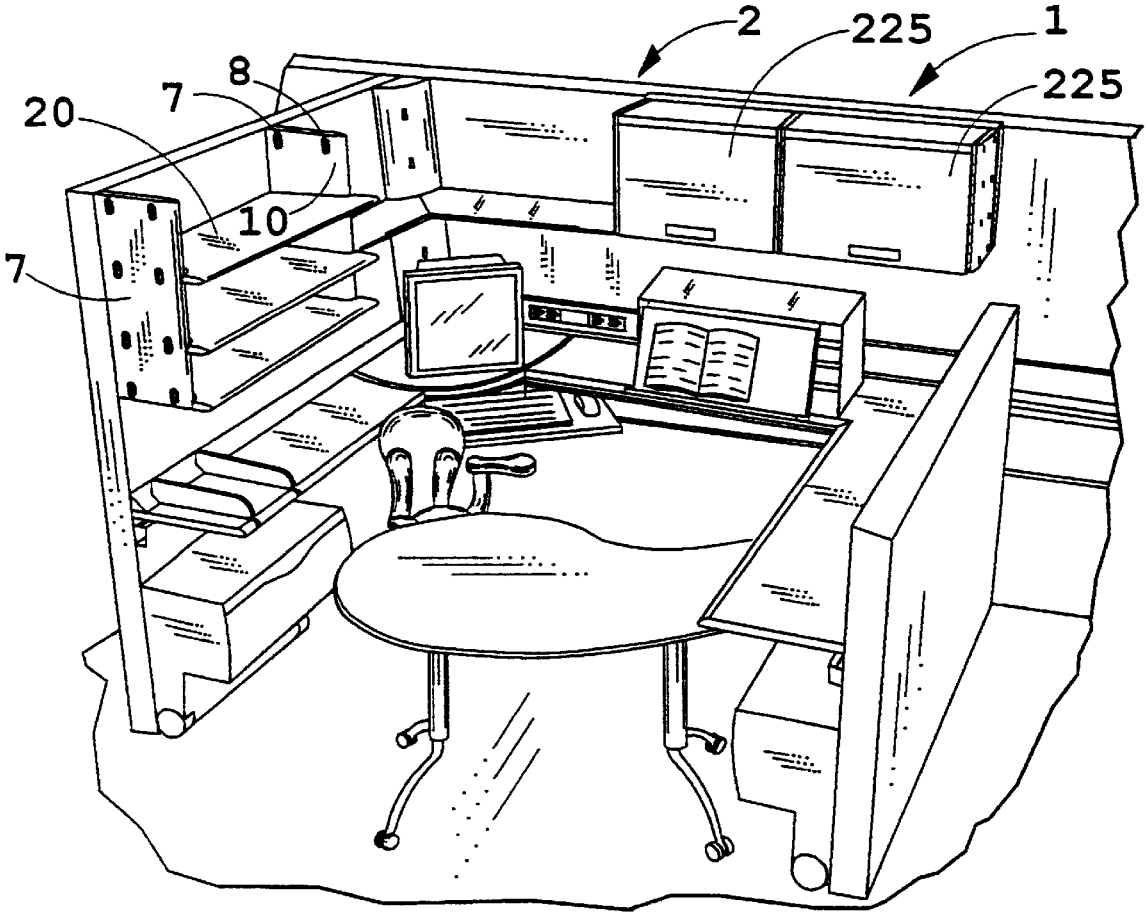
FIG. 1 is perspective view of a partition panel system with adjustable storage according to the present invention.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1B:
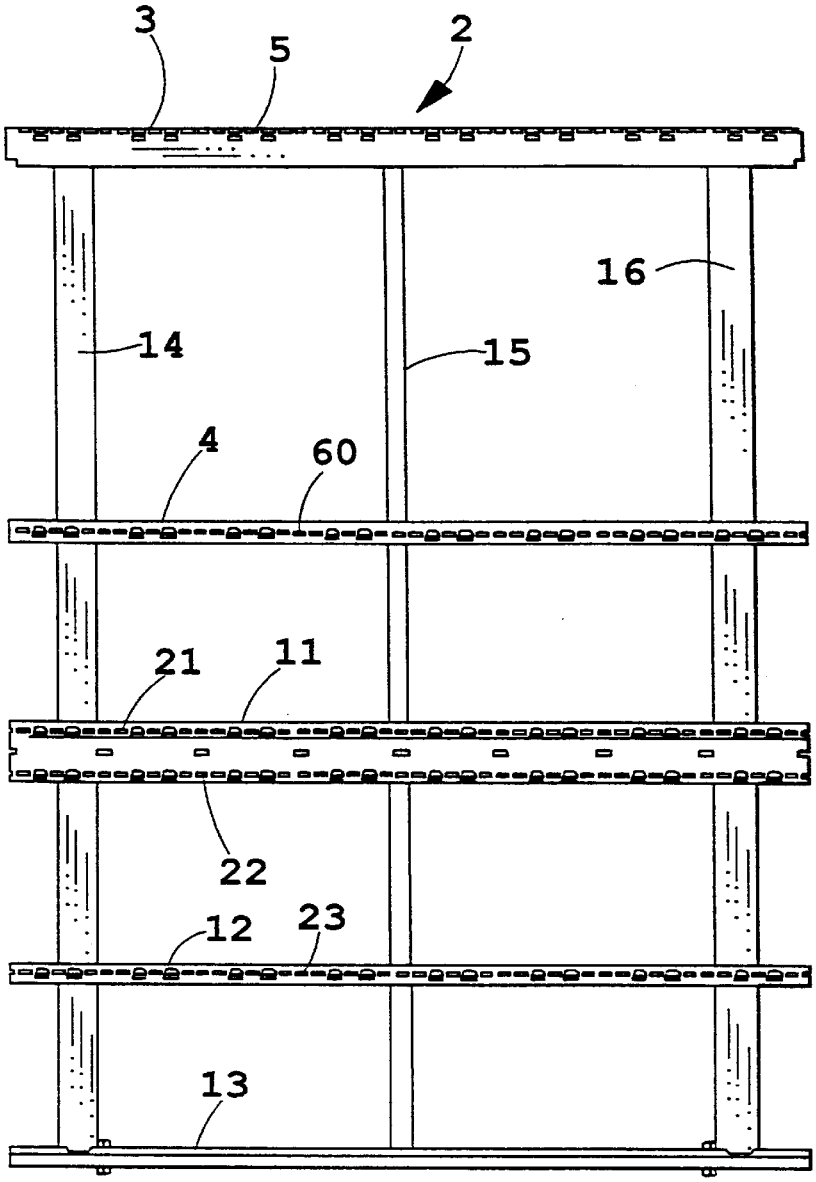
FIG. 1B is a front elevational view of the partition frame of FIG. 1.
Figure 1C:
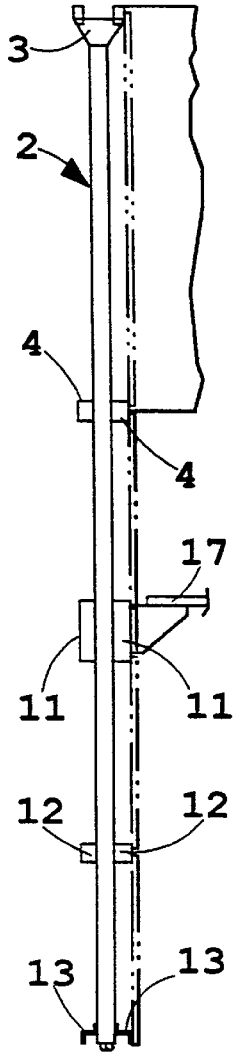
FIG. 1C is a side elevational view of the partition frame of FIG. 1.
Figure 2:
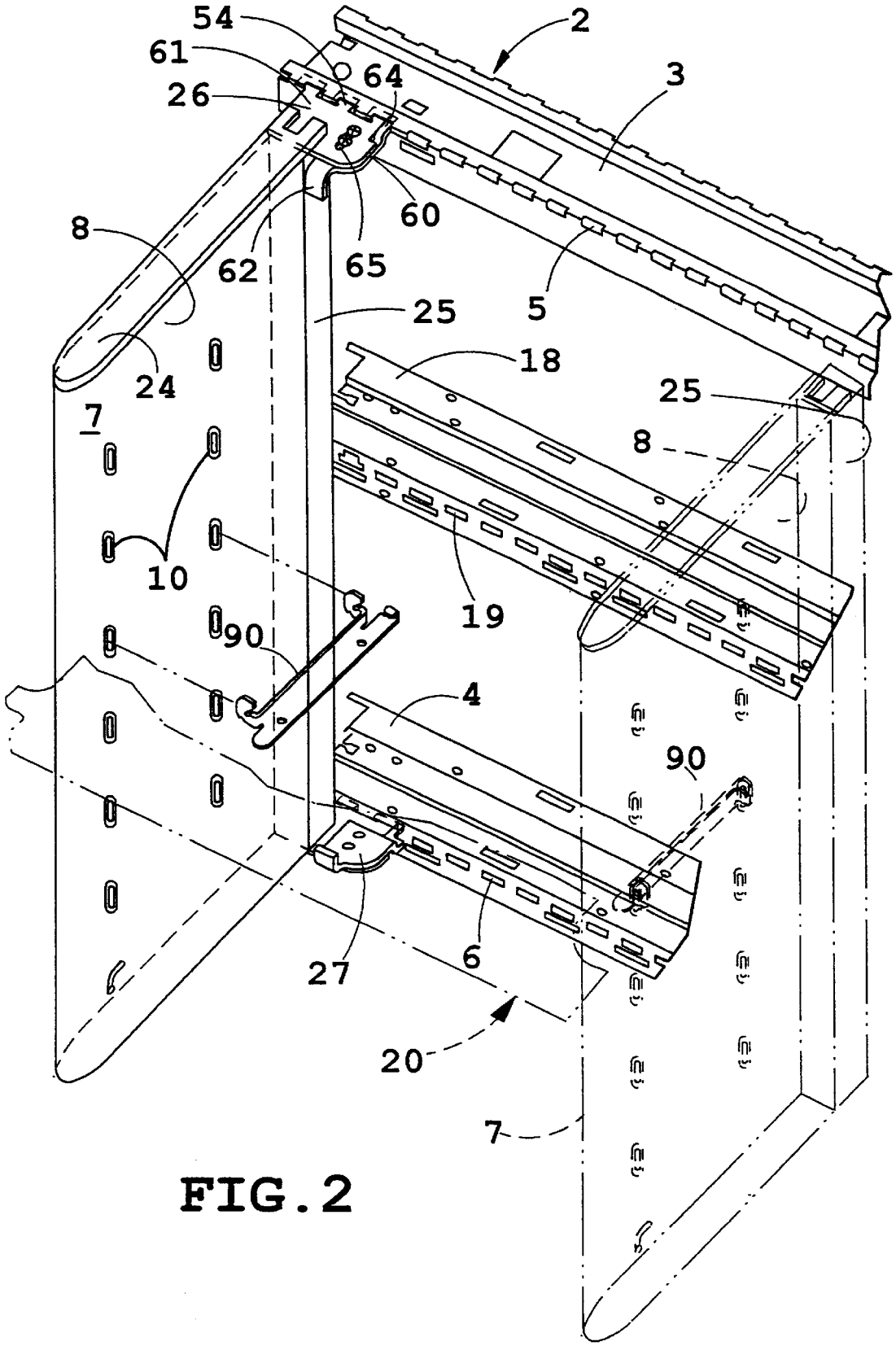
FIG. 2 is a fragmentary, perspective view of the partition frame, blades and shelf of FIG. 1.

The reference numeral 1 (FIG. 1) generally designates a partition panel system embodying the present invention, which is particularly designed for use in open office plans, and other similar settings and environments. In the illustrated example, partition panel system 1 includes a partition frame 2 (FIGS. 1B, 1C) with vertically-spaced horizontal frame members 3 and 4, each of which includes a row of first discrete attachment locations such as slots 5, 6. With reference to FIG. 2, the partition panel system also includes a pair of horizontally-spaced blades 7 that are releasably attached to selected ones of the upper and lower rows of slots 5, 6. The blades include opposing inner surfaces 8 that define vertically-spaced second discrete attachment locations such as hanger slots 10. At least one shelf 20 is releasably attached to selected ones of the hanger slots 10 such that the shelf 20 is both horizontally and vertically adjustably supportable on the partition frame 2 in a selected one of a variety of different discrete positions.

As described in more detail below, the blades 7 can support either a shelf 20, a corner shelf 130, or a bin 110 or 225. Furthermore, if desired for a particular application, blades 7 may have a height that is somewhat greater than that of bins 225, thereby allowing a bin 225 to be mounted between a pair of blades 7 directly above, and vertically spaced-apart from, one or more shelves 20 that are mounted to the same pair of blades as the bin. In addition, the blades can be easily moved horizontally in discrete increments by a user to provide horizontal adjustment of the shelf and/or bin location. A user can also easily remove a shelf 20 or bin 225 from the blades 7, and reattach the shelf 20 or blade 225 at a different, discrete vertical location. Accordingly, the side mounting arrangement provides simple and convenient vertical and horizontal adjustability, while minimizing the difficulties normally encountered with installation and/or removal of storage units.

Figure 3:
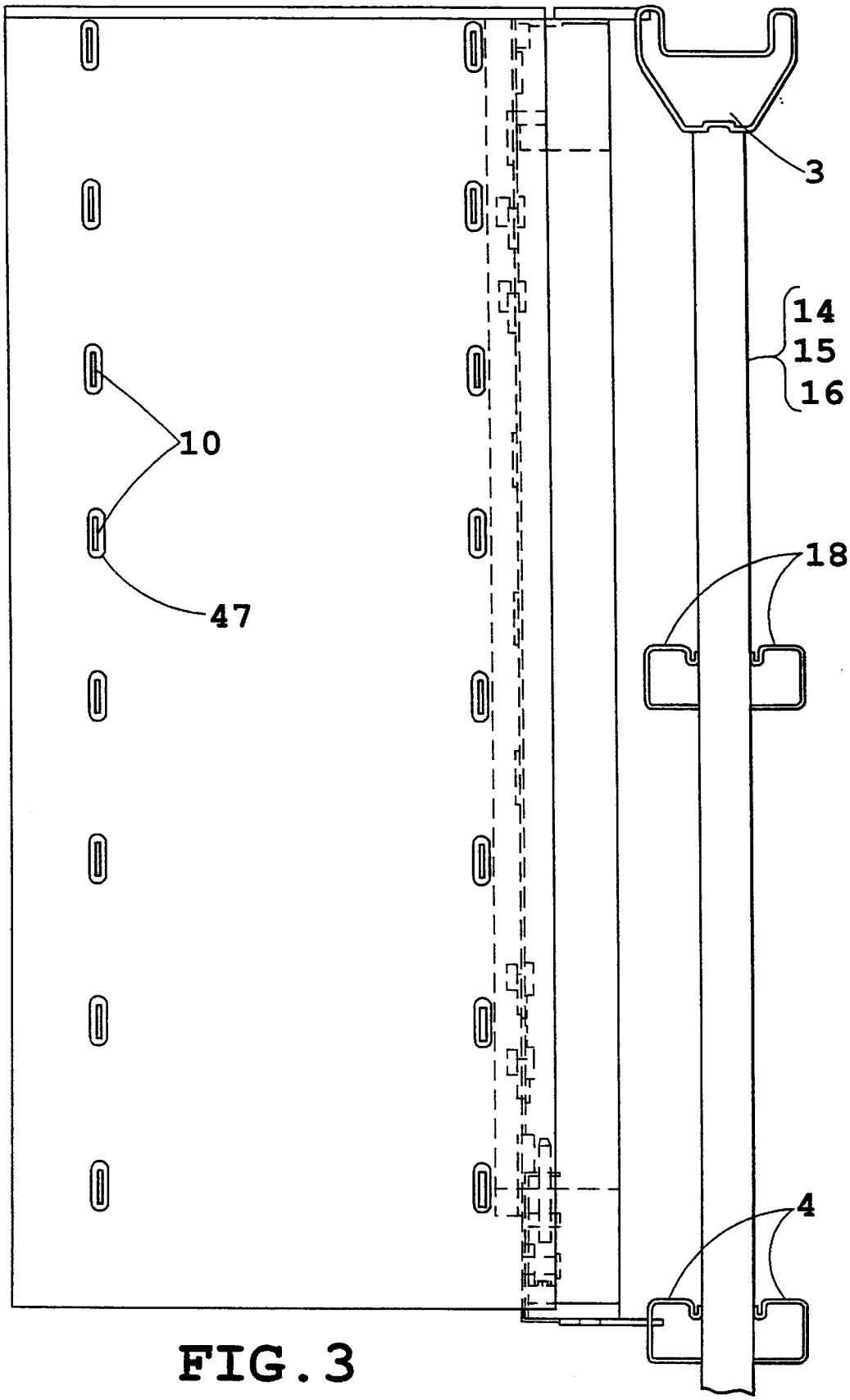
FIG. 3 is a side elevational view of the partition frame and blade of FIG. 1.

The partition frame 2 is substantially the same as that described in coassigned applications Ser. Nos. 08/701,664, 08/687,724 and 08/579,614 identified above and incorporated by reference. Accordingly, the partition frame 2 will not be described in detail herein. The partition frame 2 includes vertically spaced-apart horizontal members 3, 4, 11, 12 and 13 which are connected to the uprights 14, 15 and 16 to form a generally quadrilateral frame section. As best seen in FIGS. 1C and 3, the horizontal members 4, 11, 12 and 13 are welded to the uprights 14, 15 and 16 on opposite sides thereof, while the upper horizontal member 3 is welded directly to the upper ends of the uprights 14, 15 and 16. Each of the frame members is roll-formed from sheet metal. The embodiment of the partition frame 2 illustrated in FIGS. 2 and 3 has an additional horizontal member 18 located between the upper horizontal member 3 and the lower horizontal member 4. The horizontal member 18 has substantially the same cross-sectional shape as the lower horizontal member 4.

Each of the horizontal members, with the exception of the base horizontal member 13, include a horizontal row of slots designated 5, 6, 19, 21, 22 and 23, respectively. The horizontal rows of slots provide discrete attachment locations for the blades 7 and are located at evenly-spaced horizontal intervals, such as one inch. This arrangement provides horizontal adjustability of the blades 7, and also allows the blades to be easily positioned with the proper spacing between the blades 7 to correspond to the length of a shelf 20 or bin 110 or 225.

Each of the blades 7 comprises a planar blade portion 24 and a vertically elongated upright attachment member 25 that connects the planar blade portion 24 to the frame 2 (FIG. 2). As described in more detail below, each of the upright attachment members 25 includes an upper end such as hooked portion 26 and a lower end such as hooked portion 27 that engage the upper and lower horizontal rows of slots 5 and 6, respectively, to removably attach the blades 7 to the horizontal members 3 and 4.

Figure 2A:
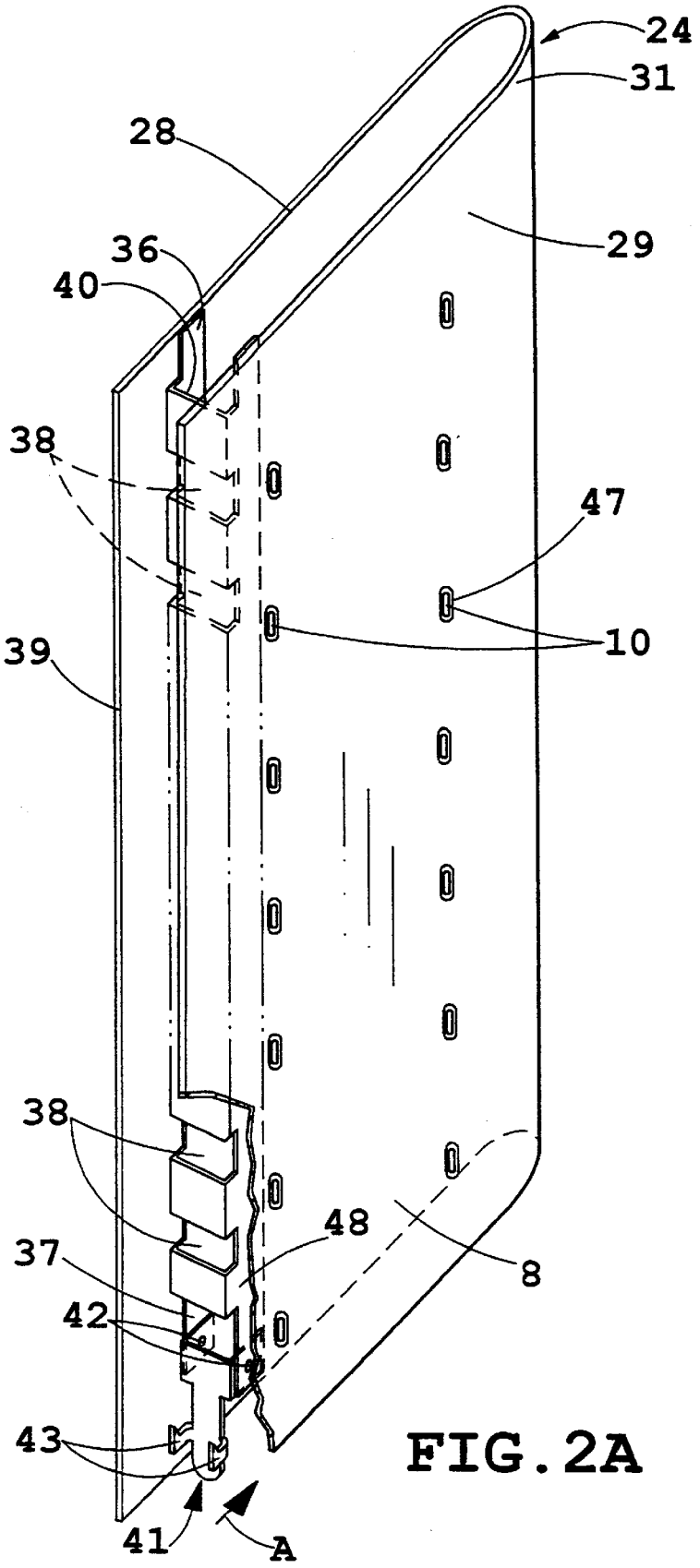
FIG. 2A is a perspective view of the blade of FIG. 1.

As illustrated in FIG. 2A, each planar blade portion 24 includes a sheet metal skin 28 that is bent around such that inner and outer sidewalls 29, 30 of the planar blade portion 24 are parallel. The forward portion 31 of the skin 28 forms an elliptical shape with the major axis of the ellipse being parallel to, and coincident with, the center plane of the planar blade portion 24. Each planar blade portion 24 includes a brace 36 extending along a rear edge 39 that is welded to the sidewalls 29 and 30 of the sheet metal skin 28. Brace 36 is formed from sheet metal, and has a generally U-shaped cross-sectional shape. Openings or slots 38 along the rear wall 40 of brace 36 removably connects the planar portions 24 of the blades to the hooks of the upright attachment member 25 as described in more detail below. The inner sidewall 29 and the outer sidewall 30 each have two vertical rows of hanger slots 10. An oval-shaped indented portion 47 around each slot 10 is deformed inwardly, and is provided for decorative purposes. Because the blades 7 have vertical rows of hanger slots 10 on each side, each blade 7 can support an end of a shelf on both the inner sidewall 29 and the outer sidewall 30. Blades 7 can be sized to accommodate various numbers and/or sizes of shelves and/or bins and required for a given application.

Figure 8:
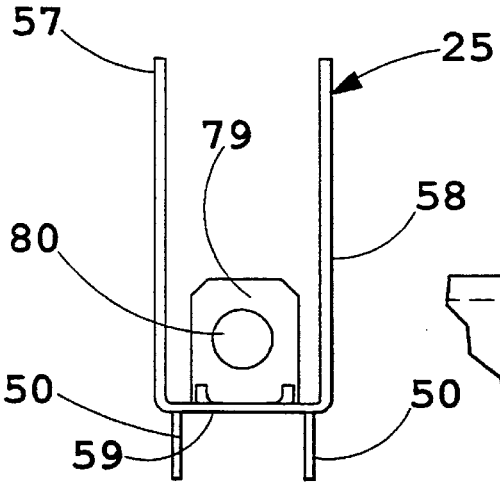
FIG. 8 is an end view of the upright support member of FIG. 2.
Figure 8A:
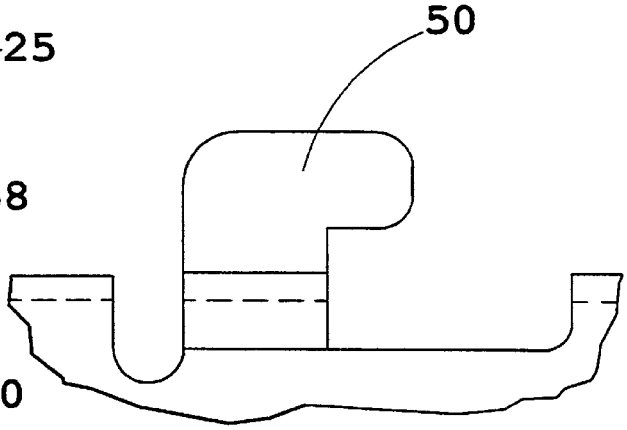
FIG. 8A is a fragmentary view of the hooks of FIG. 7.
Figures 8B, 8C, 8D, 8E, 8F, 8G, 8H, 8I:
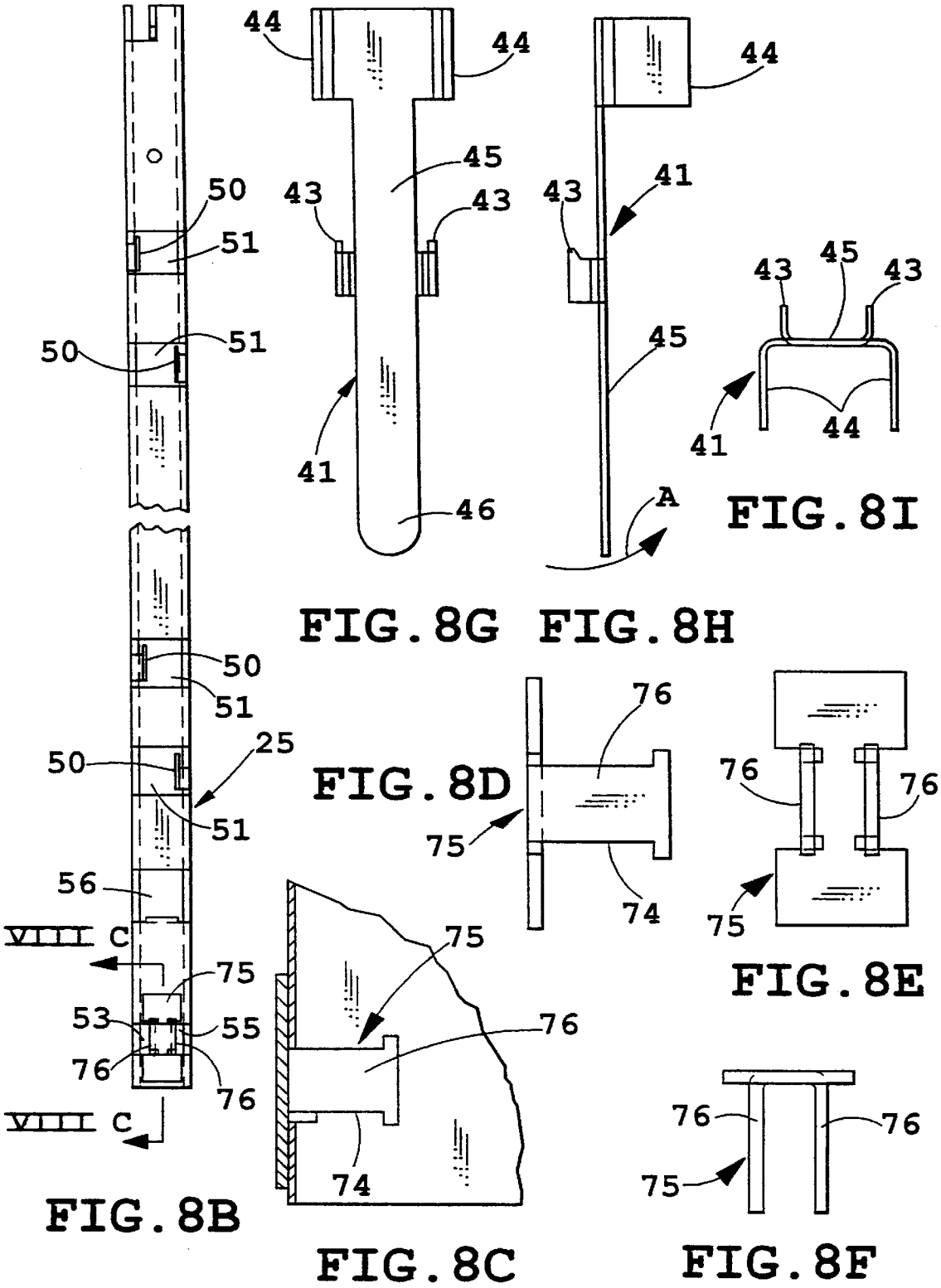
FIG. 8B is a fragmentary, side elevational view of the upright support member of FIG. 2 showing the screw support bracket.
FIG. 8C is a fragmentary view of the screw support bracket of FIG. 8B.
FIG. 8D is a side elevational view of the screw support bracket of FIG. 8B.
FIG. 8E is a front elevational view of the screw support bracket of FIG. 8B.
FIG. 8F is a top elevational view of the screw support bracket of FIG. 8B.
FIG. 8G is a front elevational view of the safety clip of FIG. 2A.
FIG. 8H is a side elevational view of the safety clip of FIG. 2A.
FIG. 8I is a top elevational view of the hanger and quick-connect fastener.

A safety clip 41 (FIG. 2A) is spot welded to the inside of the lower U-shaped brace 37. Each clip 41 includes a pair of upwardly-oriented hooks 43 (FIG. 8H) that fit around extensions 76 of bracket 75 and engage the upper edge 55 of the opening 53 in the upright attachment member 25 (FIG. 8B). Each clip 41 (FIGS. 8G, 8H and 8I) includes a pair of tabs 44 that are spot welded to the lower portion of brace 36 at 42. Each clip 41 is made of a spring steel, and includes an elongated, flat body portion 45 with a rounded lower edge 46. When the planar blade portion 24 of the blade 7 is installed on the upright attachment member 25, and the clip 41 is in an unstressed condition, the hooks 43 engage the upper edge 55 of opening 53 thereby preventing disengagement of openings 38 from hooks 50 in upright attachment member 25 (FIG. 8B). When the clip 41 is in the unstressed condition the planar blade portion 24 of the blade 7 cannot be raised to disengage hooks 50 from openings 38. To remove the planar blade portion 24 from upright 25, clip 41 is flexed in the direction of the arrow "A" (FIGS. 2A and 8H), moving hooks 43 out of engagement with opening 53. During removal of planar blade portion 24 from upright 25, the user flexes safety clip 41 to a disengaged position with one hand, while simultaneously raising the planar blade portion 24 of the blade for removal from the upright attachment member 25.

Figure 6:
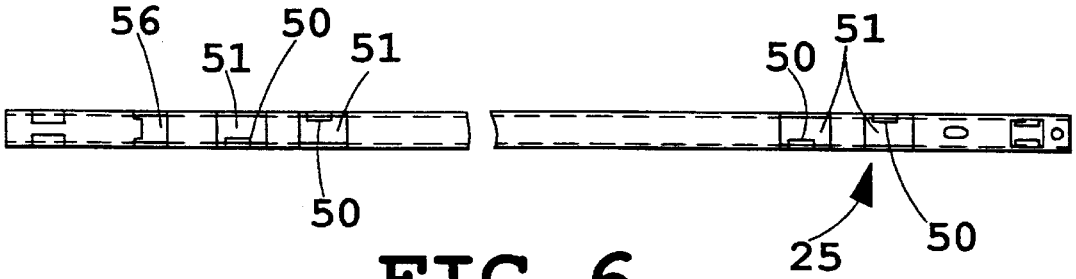
FIG. 6 is a fragmentary, top elevational view of the upright support member of FIG. 2.
Figure 7:
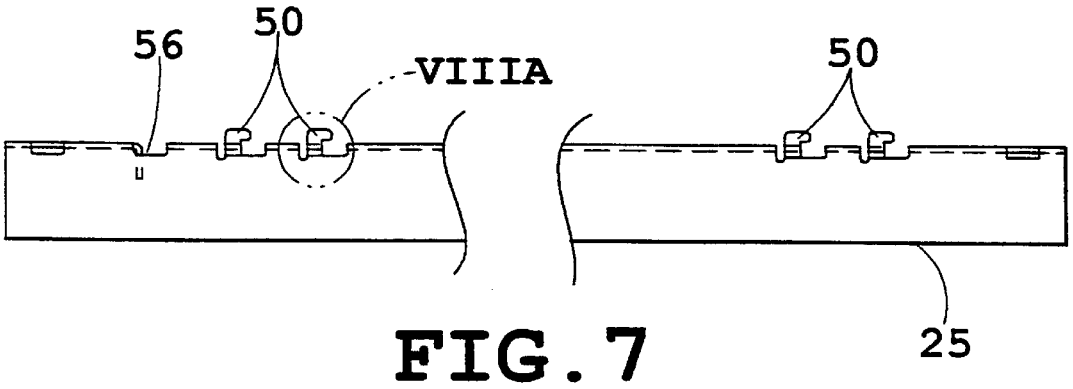
FIG. 7 is a fragmentary, front elevational view of the upright support member of FIG. 2.

Each upright attachment member 25 is formed from sheet steel and has a generally U-shaped cross-sectional shape (FIGS. 6, 7). The cross-sectional shape of the upright attachment member 25 includes a first leg or side 57, a second leg or side 58, and a base leg or side 59 (FIG. 8). Hooks 50 open upwardly, and engage openings 38 in U-shaped brace 36 to removably support the planar blade portion 24 on the upright attachment member 25.

Figure 4:
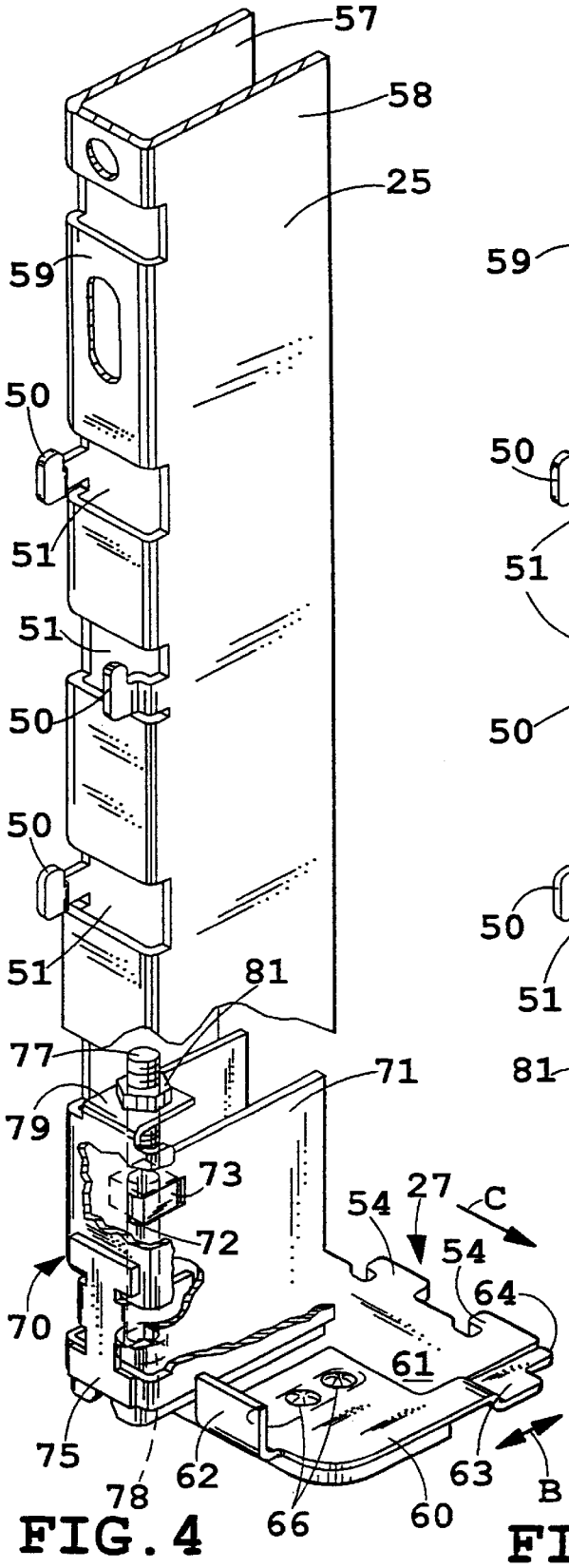
FIG. 4 is a fragmentary, perspective view of the lower hooked portion and lower safety catch of FIG. 2 in the locked position.
Figure 5:
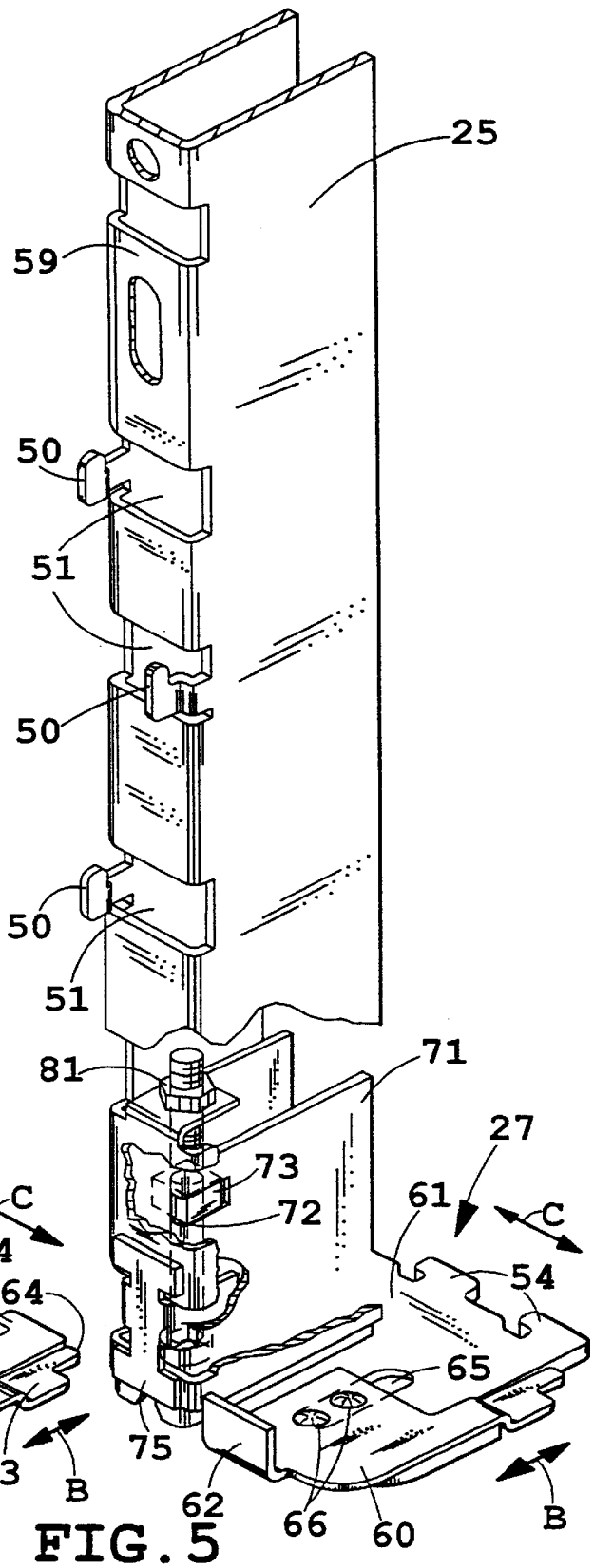
FIG. 5 is a fragmentary, perspective view of the lower hooked portion and lower safety catch of FIG. 2 in the unlocked position.

With reference to FIGS. 4 and 5, lower hooked portion 27 of upright 25 includes a pair of horizontally-oriented hooks 54 that are configured to engage the slots 6 in the horizontal member 4. A lower safety catch 60 is slidably mounted to the plate 61 for movement in the direction of the arrow "B". Safety catch 60 includes a tab 62 that provides a handle to allow a person installing or removing the uprights to slide the safety catch 60 in the slot 65 of the plate 61. A pair of rivets 66 or similar fasteners slidably retain safety catch 60 to steel plate 61. When safety catch 60 is in the engaged position illustrated in FIG. 4, extension 64 of the offset portion 63 of safety catch 60 is inserted into a slot 6, preventing sideways motion of the hooked portion 27 in the direction of the arrow "C", and locking hooks 54 into slots 6 of horizontal member 4.

Lower hooked portion 27 is attached to upright attachment member 25 by an adjustment mechanism 70 that allows the vertical spacing between the upper and lower hooked portions 26 and 27 to be changed if required to account for variations in the spacing between the upper horizontal row of slots 5 and the lower horizontal row of slots 6. Adjustment mechanism 70 includes a U-shaped section 71 that is welded to plate 61. U-shaped section 71 includes cut-out 72 that receives a portion of a square nut 73. A screw support bracket 75 is welded to the base side 59 of the upright attachment member 25. As illustrated in FIG. 8C, each bracket 75 includes a pair of flat extensions 76 extending inwardly through opening 53 in base side 59 at the lower end of upright attachment member 25. The head 78 of the screw 77 abuts the lower edge 74 of extensions 76 when lower hooked portion 27 is in the installed position. Screw 77 extends upwardly through the square nut 73 and through the hole 80 in the tab 79 and engages the "E clip" 81, which abuts the upper surface of the tab 79 to retain screw 77 (FIGS. 4, 5). The U-shaped section 71 is somewhat smaller than the upright attachment member 25, and extends upwardly into the upright attachment member 25 in a telescoping manner. Square nut 73 is constrained from rotation by the cut-out 72 such that screw 77 may be rotated to adjustably raise or lower the hooked portion 27 as required for a given application.

Figure 5A:
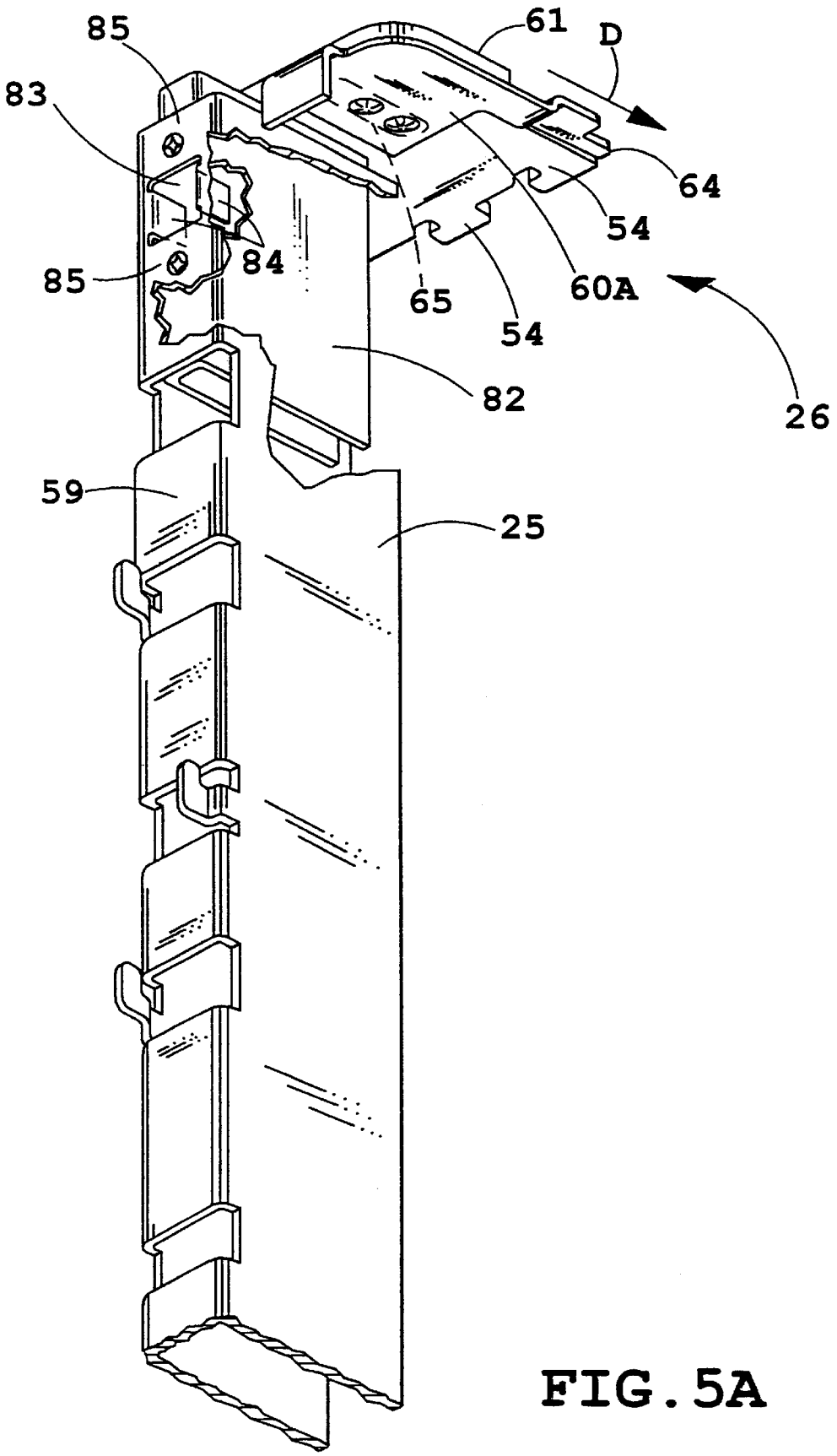
FIG. 5A is a fragmentary, perspective view of the upper hooked portion and upper safety catch of FIG. 2 in the engaged position.

With reference to FIG. 5A, upper hooked portion 26 includes a plate 61 with sidewardly-oriented hooks 54. The plate 61 is welded to upper U-shaped section 82. U-shaped section 82 fits within the upright attachment member 25. The U-shaped section 82 includes a rectangularly-shaped opening 83 which receives a pair of tabs 84 that extend inwardly from the base side 59 of the upright 25, thereby providing support for upper hooked portion 26. A pair of fasteners such as screws 85 secure U-shaped section 82 within the upright attachment member 25. The upper safety catch 60A is slidably mounted in a slot 65 in substantially the same manner as lower safety catch 60. Safety catch 60A includes an extension 64 that is received in the slots 5 in the upper horizontal member 3 upon movement of safety catch 60A in the direction of the arrow "D". Hooks 54 are thereby locked into slots 5, preventing accidental dislodgement of upright attachment member 25 from partition frame 2.

Figure 9:
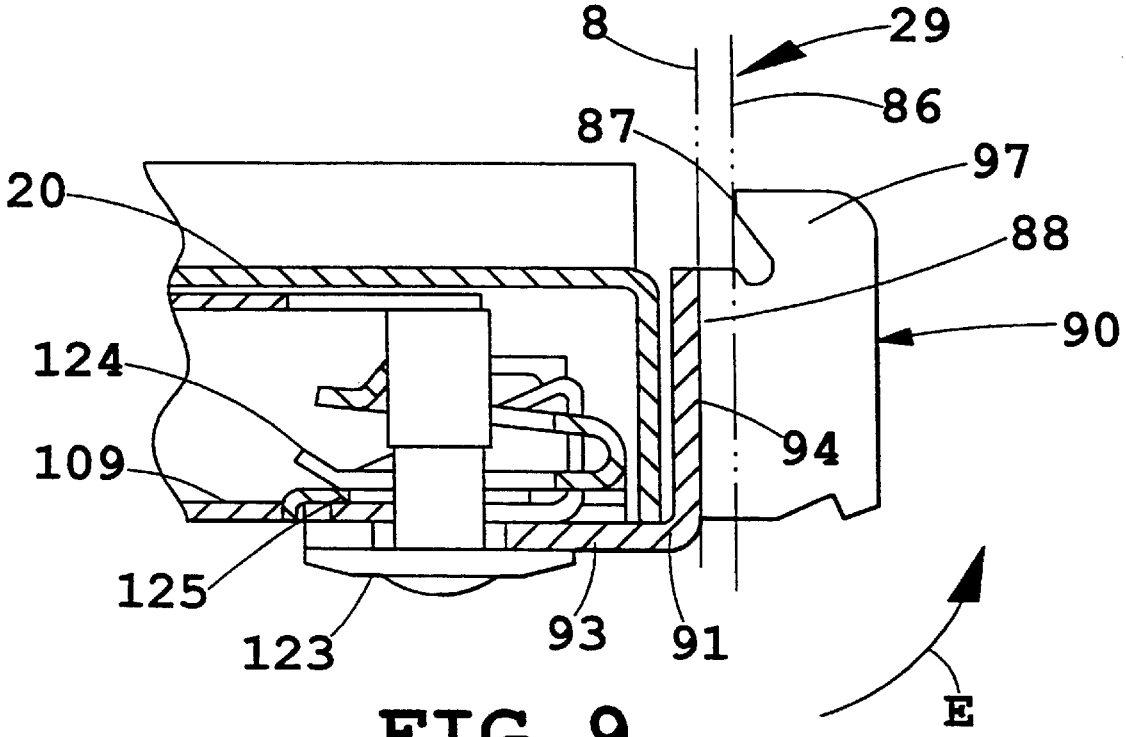
FIG. 9 is a side elevational view of the hanger of FIG. 2.
Figure 10:
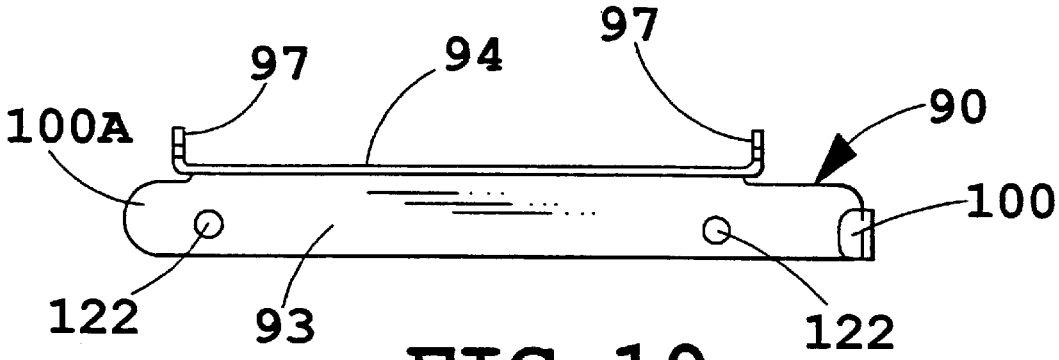
FIG. 10 is a top elevational view of the hanger of FIG. 2.
Figure 11:
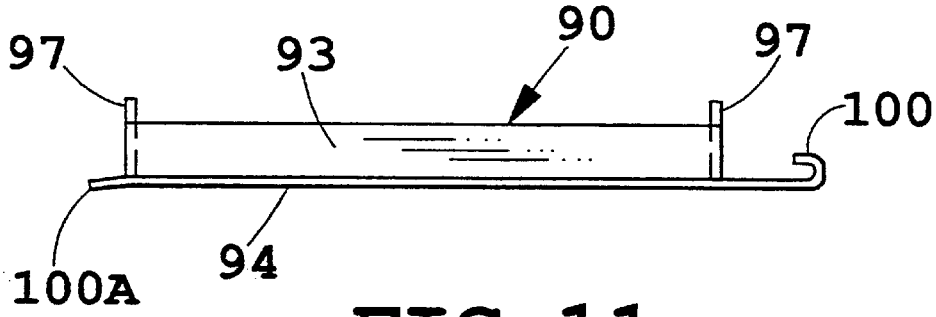
FIG. 11 is a front elevational view of the hanger of FIG. 2.

Shelf 20 is releasably attached to the hanger slots 10 by a hanger 90 located at the opposite side edges of the shelf 20 (FIG. 2). The body portion 91 of the hanger 90 forms an L-shaped support flange 92 having an outer, or horizontal leg 93 and a vertical or inner leg 94 (FIGS. 9–11). In the illustrated embodiment, vertical leg 94 has orthogonal portions at each end forming protrusions such as upwardly-extending hook portions 97 that are configured to releasably engage openings such as hanger slots 10 in blades 7. The "right hand" hanger 90 is a mirror image of the "left hand" hanger 90 illustrated in FIGS. 10 and 11.

As described in more detail below, the hangers 90 may be used to support either a shelf 20 or a storage bin 110 or 225. When installing the hangers 90 to blades 7, hangers 90 are engaged with the hanger slots 10 by inserting the hooks 97 into the slots 10 with the hangers 90 in a sideways position (i.e., rotated 90° clockwise from the position shown in FIG. 9). The hanger 90 is then rotated counter-clockwise downwardly approximately 90 degrees in the direction of arrow "E" until the upright position illustrated in FIG. 9 is reached. The hanger 90 on the opposite blade is installed in a similar manner by rotation in an opposite direction. In the upright position the inner surface 88 of the leg 94 of support flange 92 abuts the inner surface 8 of the blade 7 such that further rotation of the hanger 90 is prevented. In the upright, installed position, tip 87 of hook 97 abuts the inner surface 86 of the inner side 29 of the sheet metal skin 28 of the blade 7, such that hanger 90 cannot be dislodged from the blade 7 without first rotating the hanger 90 upwardly to the sideways position. Each hanger 90 includes an inwardly-extending tab 100 which is received into a slot 101 (FIG. 13B) formed in the rear wall of a shelf 20, corner shelf 130 or storage bin 110 or 225. The leg 93 of each hanger 90 includes a forwardly-extending portion 100A that is bent downward slightly to facilitate installing the shelf or bin on the hanger 90. During installation of a shelf 20 or storage bin 110, the hanger 90 is first installed to the blade 7 as described above. The shelf 20 or storage bin 110 is then slid rearwardly while resting on the legs 93 of the hangers 90, until the tab 100 is received into the slot 101 located in the rear wall of the shelf 20 or storage bin 110. The studs 123 are then installed as described above to lock the shelf 20 or storage bin 110 to the hangers 90.

Each hanger 90 includes a pair of openings 122 which receive a quick-acting fastener such as a DZUS half-turn stud 123 (FIG. 9). A DZUS receptacle 124 clips onto an indented, notched side edge 125 of a shelf 20 or a storage bin 110. Each shelf or bin includes two indented portions 125 on each side edge. Each indention 125 is spaced-apart to correspond to openings 122 in hangers 90, and receives a DZUS receptacle 124. The one half-turn stud 123 and receptacle 124 may be purchased from DZUS Fastener Company, Inc., Islip, N.Y. The DZUS fastener arrangement acts as a shelf lock and releasably connects a shelf 20, or storage bin 110 to the hanger 90. Because the DZUS fasteners rigidly connect hanger 90 to the shelf 20 or storage bin 110, the hanger 90 cannot be rotated for removal from the blade 7 after the studs 123 are installed.

Figure 14:
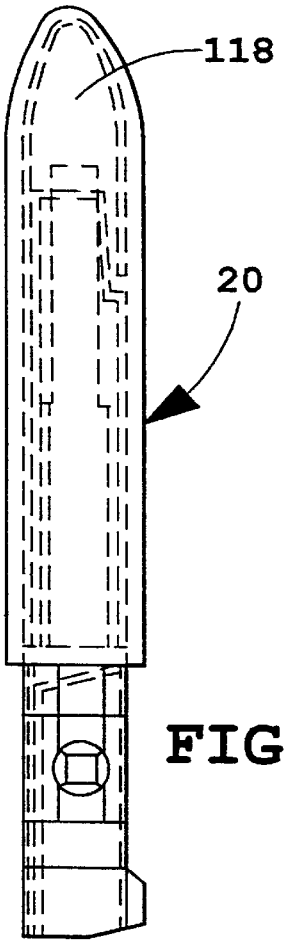
FIG. 14 is a fragmentary view of the shelf of FIG. 13.
Figure 14A:
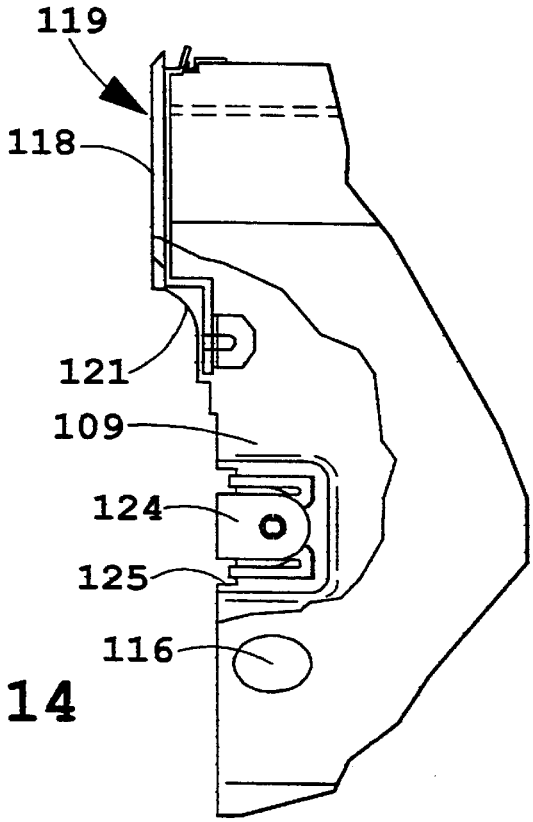
FIG. 14A is a fragmentary view of the edge portion of the shelf of FIG. 12.
Figure 12:
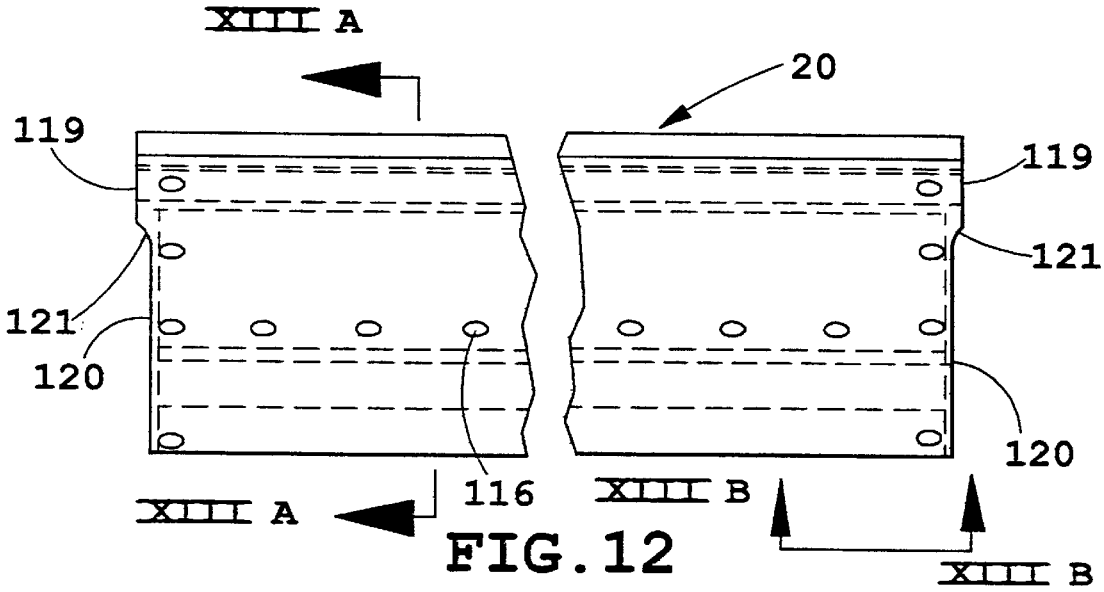
FIG. 12 is a bottom plan view of the shelf of FIG. 1.
Figure 13:
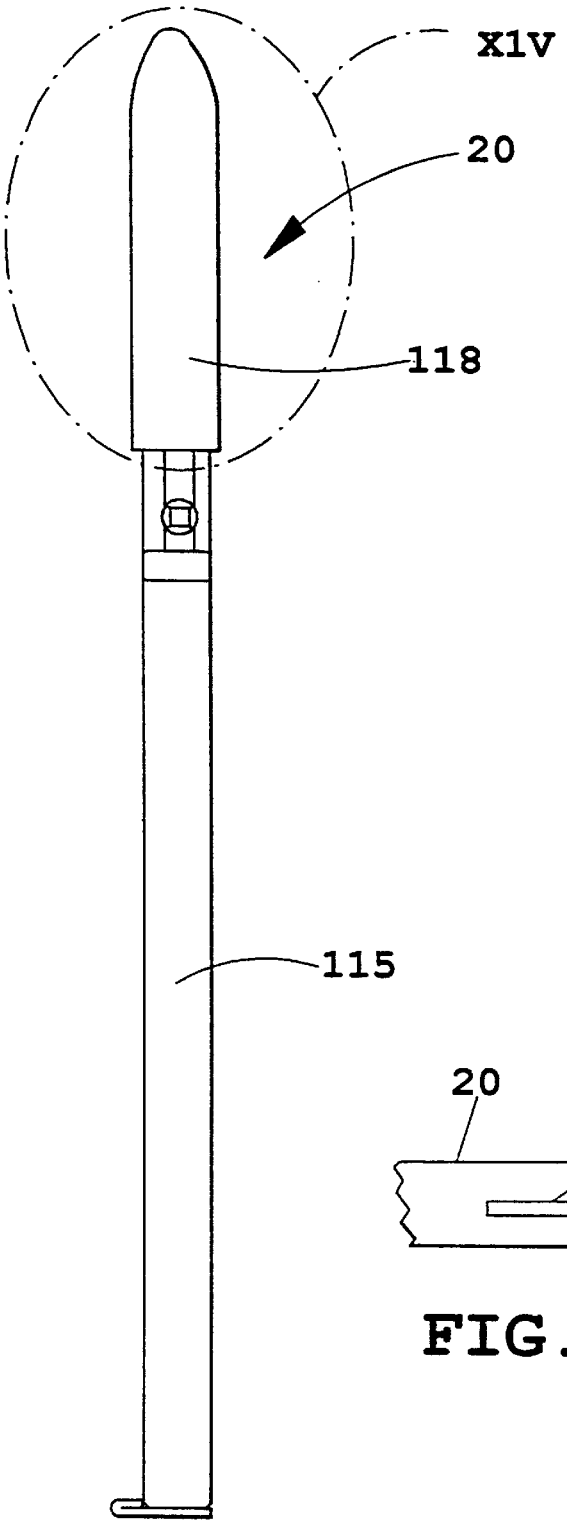
FIG. 13 is a side elevational view of the shelf of FIG. 1.
Figure 13B:
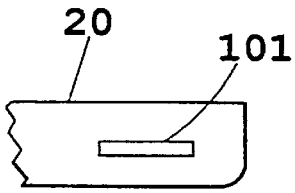
FIG. 13B is a view of the shelf taken along the line XIIB—XIIB of FIG. 12.
Figure 13A:
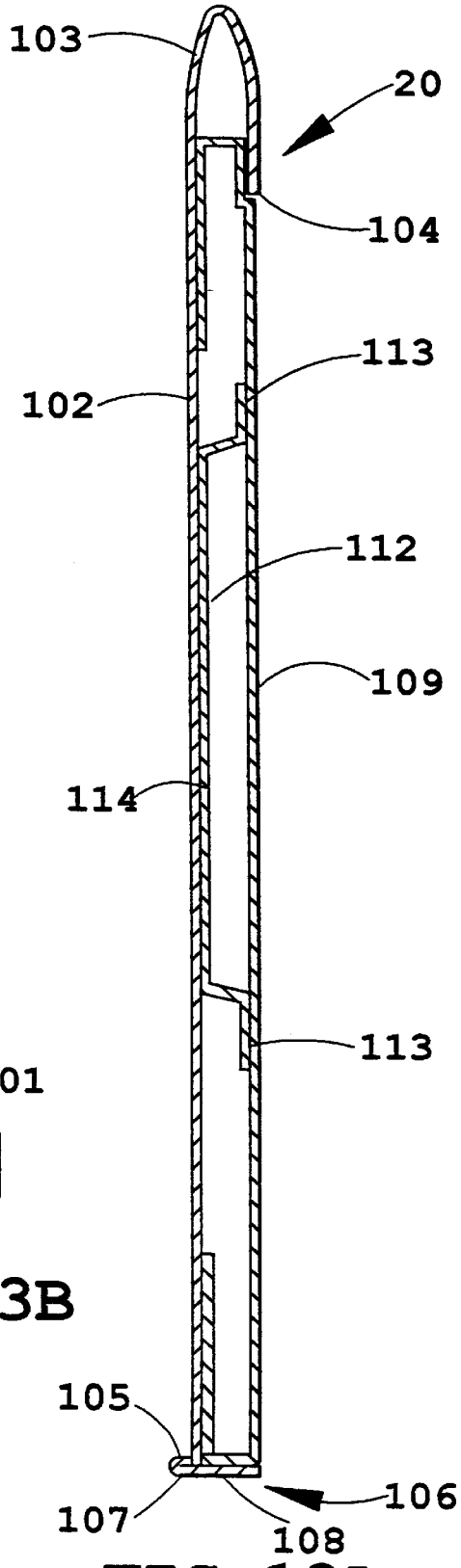
FIG. 13A is a cross-sectional view of the shelf taken along the line XIIIA—XIIIA of FIG. 12.

Shelf 20 includes an upper wall 102 that is formed from sheet metal with an elliptical forward portion 103 that terminates at a rear edge 104 (FIG. 13A). Flange 105 at the rear edge 106 of the shelf 20 includes an upwardly extending section 107 that is folded over and extends downward at 108 to form rear edge 106 of shelf 20. The lower wall 109 of shelf 20 is also formed from sheet metal and is bonded or welded to the upper wall 102 adjacent the edge 104 of the elliptical forward portion 103, and adjacent the downwardly extending portion 108 of the flange 105. Each shelf includes a hat-shaped channel 112 extending between the upper sheet metal section 102 and the lower sheet metal portion 109 for reinforcement. The hat-shaped channel 112 is welded to the upper portion 102 along the wall 114, and is welded to the lower portion 109 along the edge flanges 113. Upper portion 102 includes downwardly extending side flanges 115 that close off the ends of the shelves 20 (FIG. 13). Shelf 20 includes an end cap 118 that closes off the opposite side edges 120 of the shelves 20 adjacent the sidewardly-extending front portion 119 thereof (FIG. 14). Each side edge 120 includes an elliptically-shaped section 121 such that the side edges taper outwardly adjacent the sidewardly extending front portions 119 (FIGS. 12, 14A). The elliptically-shaped section 121 corresponds to the elliptically-shaped portion 31 of blades 7 such that the side edge 120 of the shelf 20 extends around the front edge of the blades 7 in a close-fitting manner. A plurality of weld clearance holes 116 in lower wall 109 provide clearance for spot welding during fabrication of shelf 20.

With reference to FIG. 14A, the lower sheet metal wall 109 of the shelf 20 has a pair of indented, notched portions 125, each of which receives a receptacle 124. As best seen in FIG. 9, the notched portion 125 is indented, or bent upward approximately one sheet metal thickness, such that the clip portion of receptacle 124 does not protrude downwardly beyond the lower side of the shelf 20. Notch 125 locates receptacles 124 to correspond with openings 122 in hanger 90, and also permits receptacles 124 to be mounted inboard of the shelf edge.

Figure 1A:
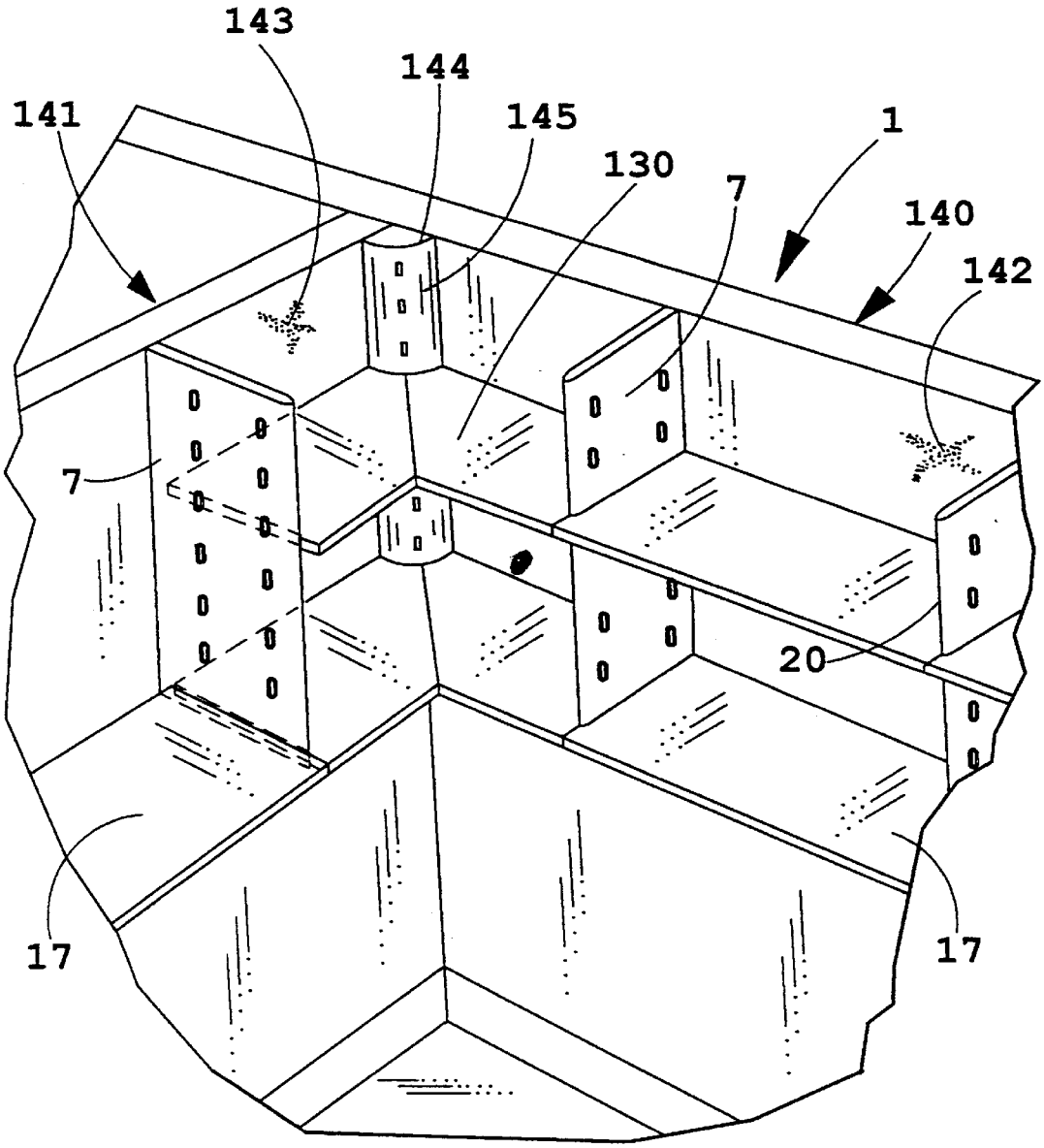
FIG. 1A is a partition panel system with an adjustable corner storage.
Figure 15:
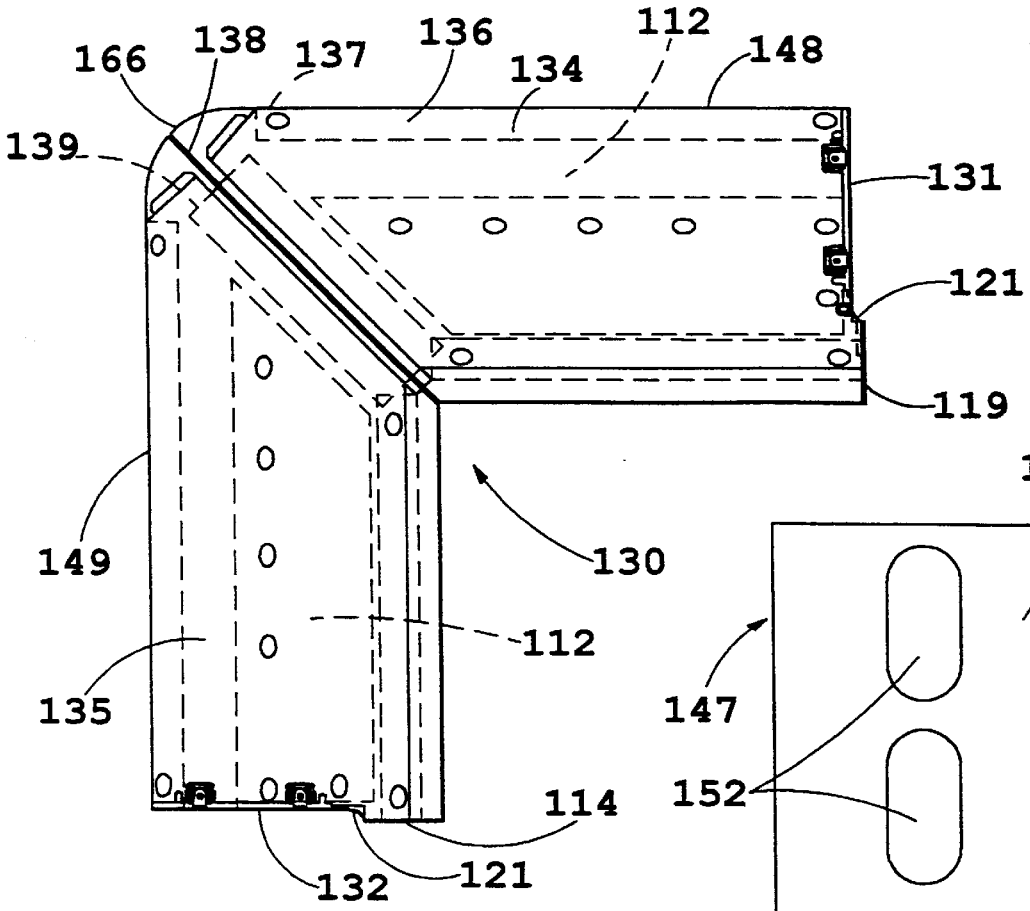
FIG. 15 is a bottom plan view of the corner shelf of FIG. 1A.

Partition panel system 1 may include a corner shelf 130 (FIGS. 1A, 15). Two substantially planar partition panels 140 and 141 define orthogonal front surfaces 142 and 143, respectively. Panels 140 and 141 are joined along a vertical junction 144. A vertically elongated corner shelf support member 145 is aligned with, and adjacent to, the vertical junction 144. Each of the panels 140 and 141 include a partition frame 2 with vertically spaced-apart horizontal members 3, 4, 11, 12 and 13. Corner support 145 includes hooked upper and lower portions formed by hooked upper bracket 146 and hooked lower bracket 147, respectively. The hooked brackets 146 and 147 removably attach corner shelf support 145 to the upper and lower horizontal rows of slots 5, 6 of the upper and lower horizontal frame members 3, 4, respectively in substantially the same manner as described above with respect to shelf 20.

With reference to FIG. 15, corner shelf 130 includes first and second opposite side edges 131 and 132, respectively. The opposite side edges 131 and 132 are substantially the same as the side edges 120 of a straight shelf 20 and each includes a pair of indented side edges 125 for attachment of receptacles 124 and studs 123. Corner shelf 130 may also include a slot 100 adjacent each rear corner to receive tab 100 of hanger 90 in substantially the same manner as described above with respect to shelf 20. Opposite side edges 131 and 132 each include a sidewardly-extending front portion 119 and an elliptically-shaped section 121 that corresponds to the elliptical front edge of the blades 7. Sidewardly extending front portion 119 extends around the front edge of the blade 7, and the elliptically-shaped section 121 fits closely against the elliptical portion of the inner surface 8 of the blade 7.

The corner shelf 130 has a cross-sectional configuration that is substantially the same as that of the straight shelf 20 illustrated in FIG. 13A. The first and second halves 134 and 135, respectively, of the corner shelf 130 each include a hat-shaped channel 112 that is welded between the upper the lower sheet metal surfaces 136 and 137. The first and second halves 134 and 135 of the shelf 130 are joined together along the diagonal seam 138 by a pair of flat, rectangular sheet metal pieces 139 that are welded to the inner side of the upper and lower shelf surfaces 136 and 137. The corner shelf 130 includes orthogonal first and second rear edge portions 148 and 149 that are configured to align with the front surfaces 142, 143 of the partition panels 140 and 141 in close proximity thereto.

Figure 16:
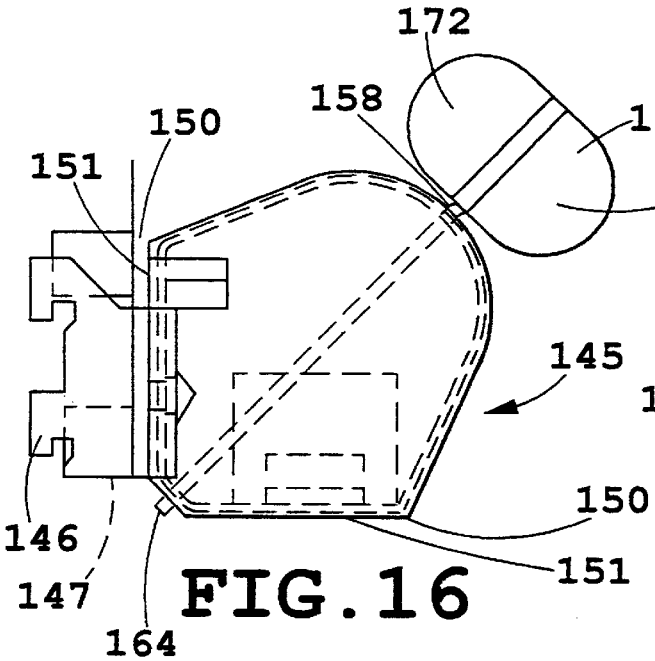
FIG. 16 is a top plan view of the corner support assembly of FIG. 1A.
Figure 22:
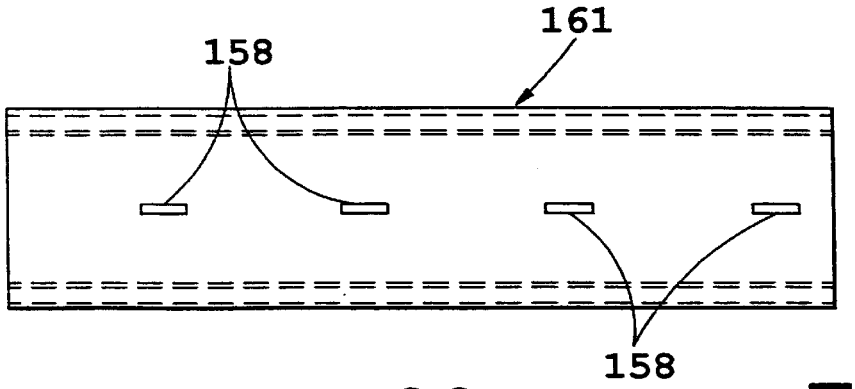
FIG. 22 is a front elevational view of the U-shaped front of the corner shelf support assembly of FIG. 16.
Figure 23:
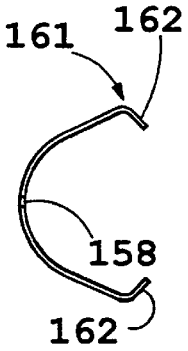
FIG. 23 is a side elevational view of the U-shaped front of the corner shelf support assembly of FIG. 16.

The corner shelf support assembly 145 (FIG. 16) includes a rear portion 160 (FIGS. 24, 25) that is substantially V-shaped, and a front portion 161 that is substantially U-shaped (FIGS. 22, 23). The vertical flanges 162 of the U-shaped front portion are bonded or welded to the V-shaped rear portion along the edges 163 to form the joint 150. As best seen in FIG. 16, the corner shelf support has a substantially tubular cross-sectional shape with orthogonal rear faces 151 that correspond to the front surfaces 142 and 143 of the panels 140 and 141 at the vertical junction 144 when in the installed position.

Figure 17:
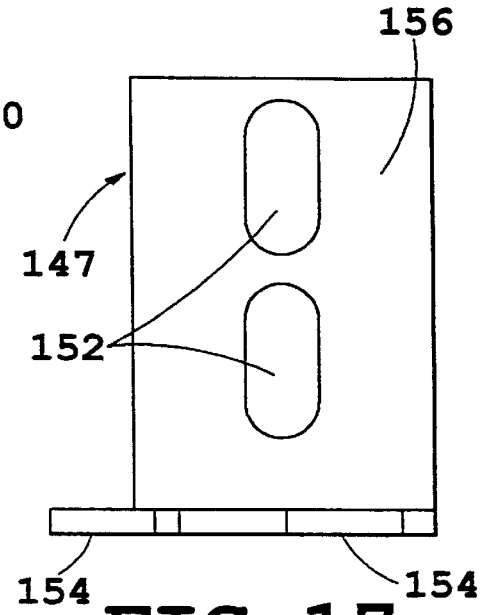
FIG. 17 is a top elevational view of the hooked lower bracket of FIG. 16.
Figure 18:
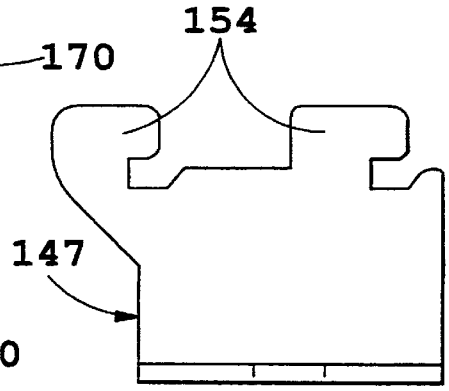
FIG. 18 is a front elevational view of the hooked lower bracket of FIG. 16.
Figure 19:
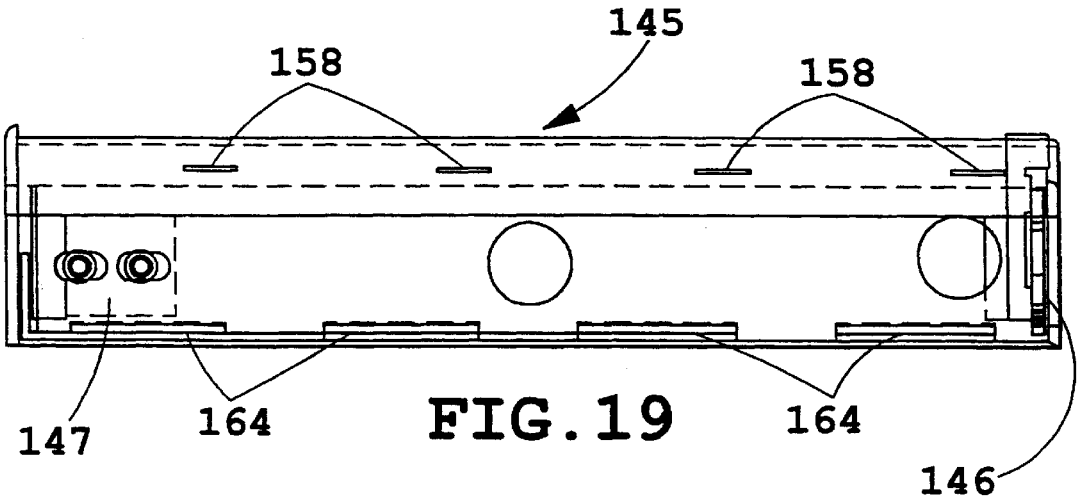
FIG. 19 is a top elevational view of the corner support assembly of FIG. 16.
Figure 20:
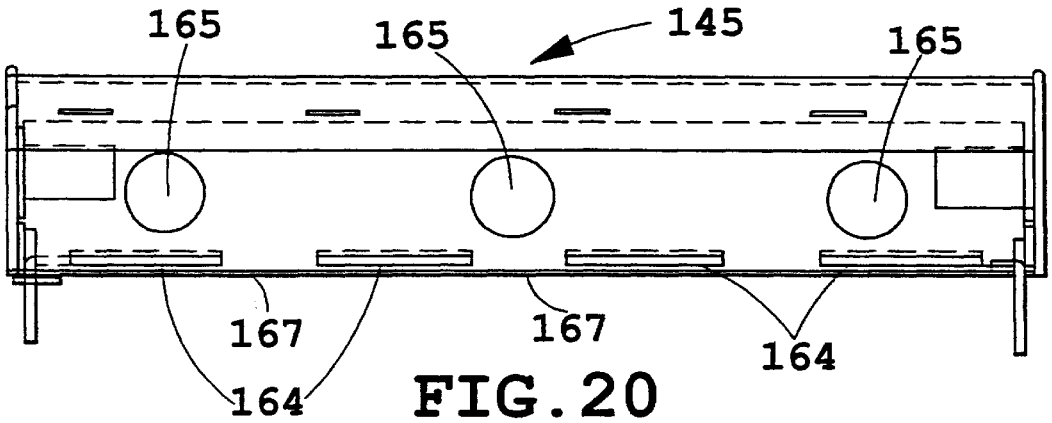
FIG. 20 is front elevational view of the corner shelf support assembly of FIG. 16.
Figure 24:
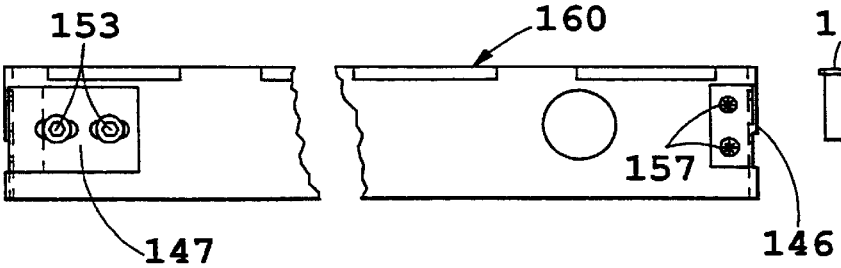
FIG. 24 is a fragmentary, front elevational view of the V-shaped rear portion of the corner shelf support assembly of FIG. 16.
Figure 25:
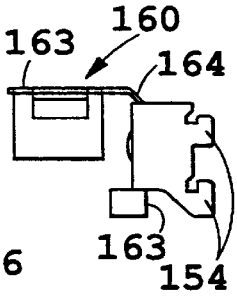
FIG. 25 is a side elevational view of the V-shaped rear portion of the corner shelf support assembly of FIG. 16.

The hooked lower bracket 147 (FIGS. 17, 18) is formed from sheet metal and includes a pair of slots 152 that receive screws 153, thereby slidably mounting the hooked lower bracket 147 to the V-shaped rear portion of the corner shelf support adjacent the lower end thereof (FIG. 24). The slots 152 permit adjustment to account for variations in the vertical spacing between the horizontal rows of slots. The hooked lower bracket 147 also includes a pair of hooks 154 that are horizontally-oriented when the corner shelf support is in the vertical, installed position.

Figure 21:
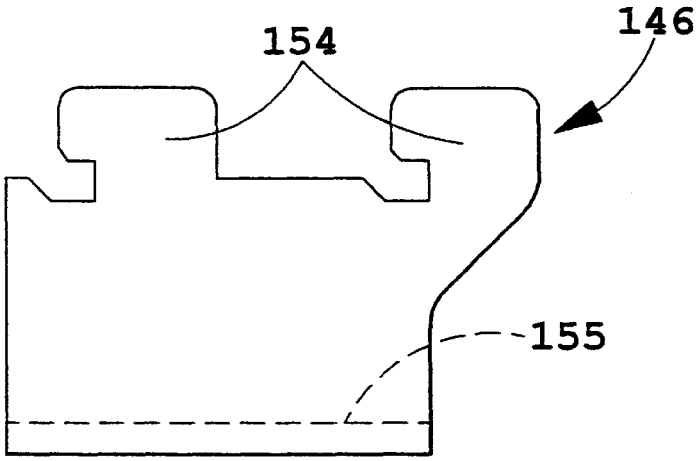
FIG. 21 is a front elevational view of the hooked upper bracket of FIG. 16.
Figure 21A:
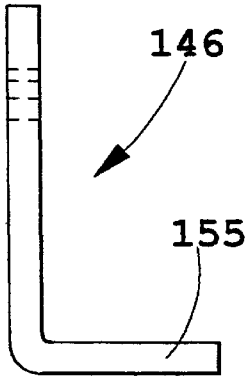
FIG. 21A is a side elevational view of the hooked upper bracket of FIG. 16.

The hooked upper bracket 146 (FIGS. 21, 21A) is substantially the same as the hooked lower bracket 147, except that the flat section 155 does not include slots. The flat section 155 of the hooked upper bracket 146 is spot welded to the V-shaped rear portion 160 of the corner shelf support at 157 (FIG. 24). The flat sections 155 and 156 of the upper and lower brackets 146 and 147, respectively, are oriented so that the hooks 154 of the upper and lower brackets are each oriented in the same horizontal direction when the hooked upper and lower brackets 146 and 147 are connected to the V-shaped rear portion of the corner shelf support 145.

Figure 26:
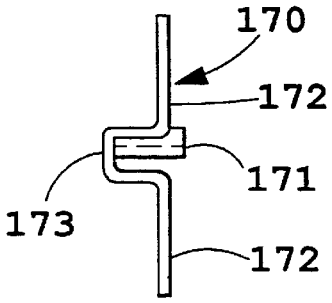
FIG. 26 is a side elevational view of the corner shelf support bracket of FIG. 16.
Figure 27:
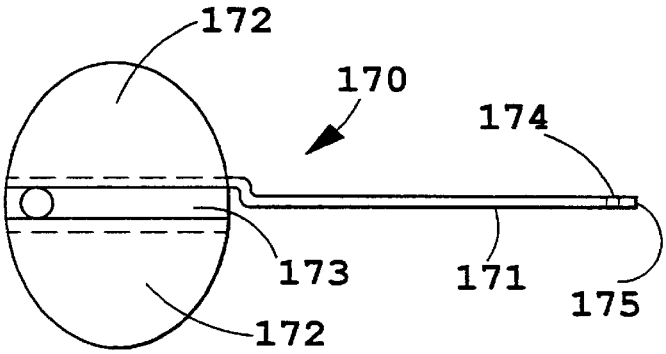
FIG. 27 is a top plan view of the corner shelf support bracket of FIG. 16.
Figure 28:
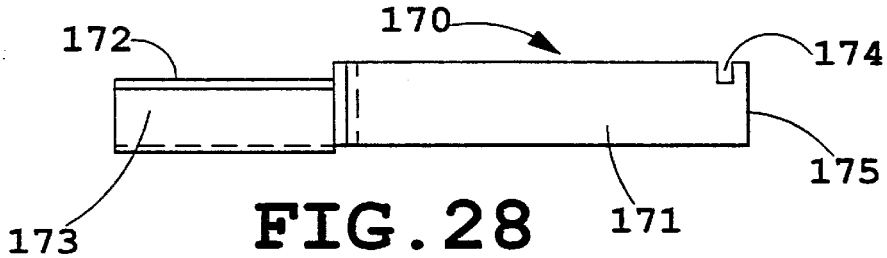
FIG. 28 is a front elevational view of the corner shelf support bracket of FIG. 16.

The U-shaped front portion of the corner shelf support 145 includes a vertical row of slots 158. The V-shaped rear portion of the corner shelf support 145 includes a vertical row of relatively large slots 164. A "butterfly" corner shelf support bracket 170 is formed from sheet metal, and includes an elongated flat portion 171 that fits through one of the forward slots 158 and also through one of the rear slots 164 in the corner shelf support 145. With reference to FIGS. 26–28, the corner shelf support bracket 170 includes two flat support portions 172 that are joined by a U-shaped section 173. The corner shelf 130 rests on the supports 172 of the bracket 170 adjacent the corner 166. Corner shelf support bracket 170 includes a notch 174 in the elongated flat portion 171 adjacent the end 175. When a weight, such as the corner shelf 130, is placed on the support portions 172 of the bracket 170, the end 175 pivots upward, causing the notch 174 to engage the upper edge 167 of the slots 164 to prevent accidental dislodgement of the bracket 170 from the corner shelf support 145. The slots 158 and 164 are located at a height corresponding to the height of hanger slots 10 in blades 7 to support corner shelf 130 at the same height as straight shelf 20, if a user so chooses. The corner shelf support bracket 170 is easily removed and installed in a selected pair of slots 158 and 164 to facilitate the vertical adjustment of the corner shelf 130 between selected discrete vertical locations.

Figure 29:
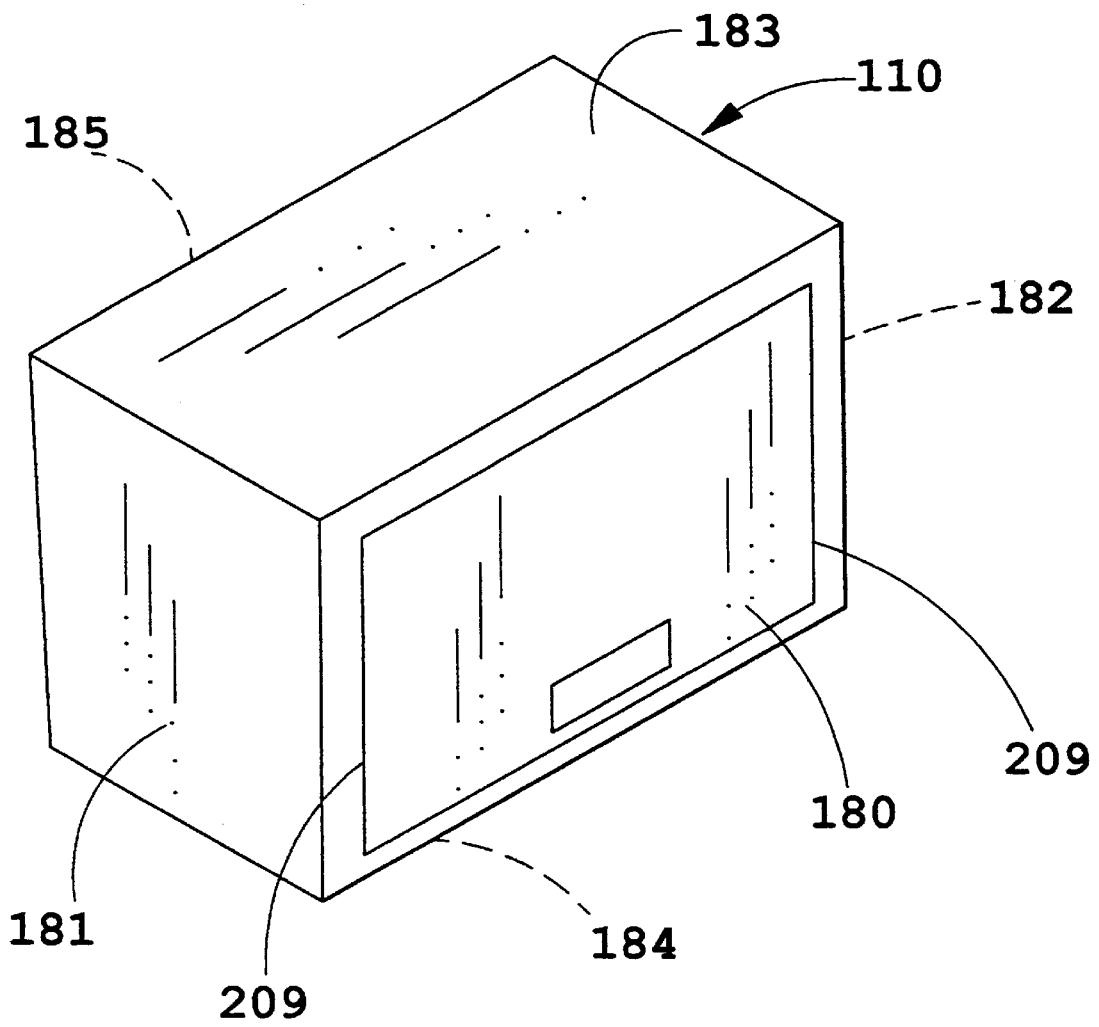
FIG. 29 is a perspective view of the storage bin of FIG. 1.
Figure 30:
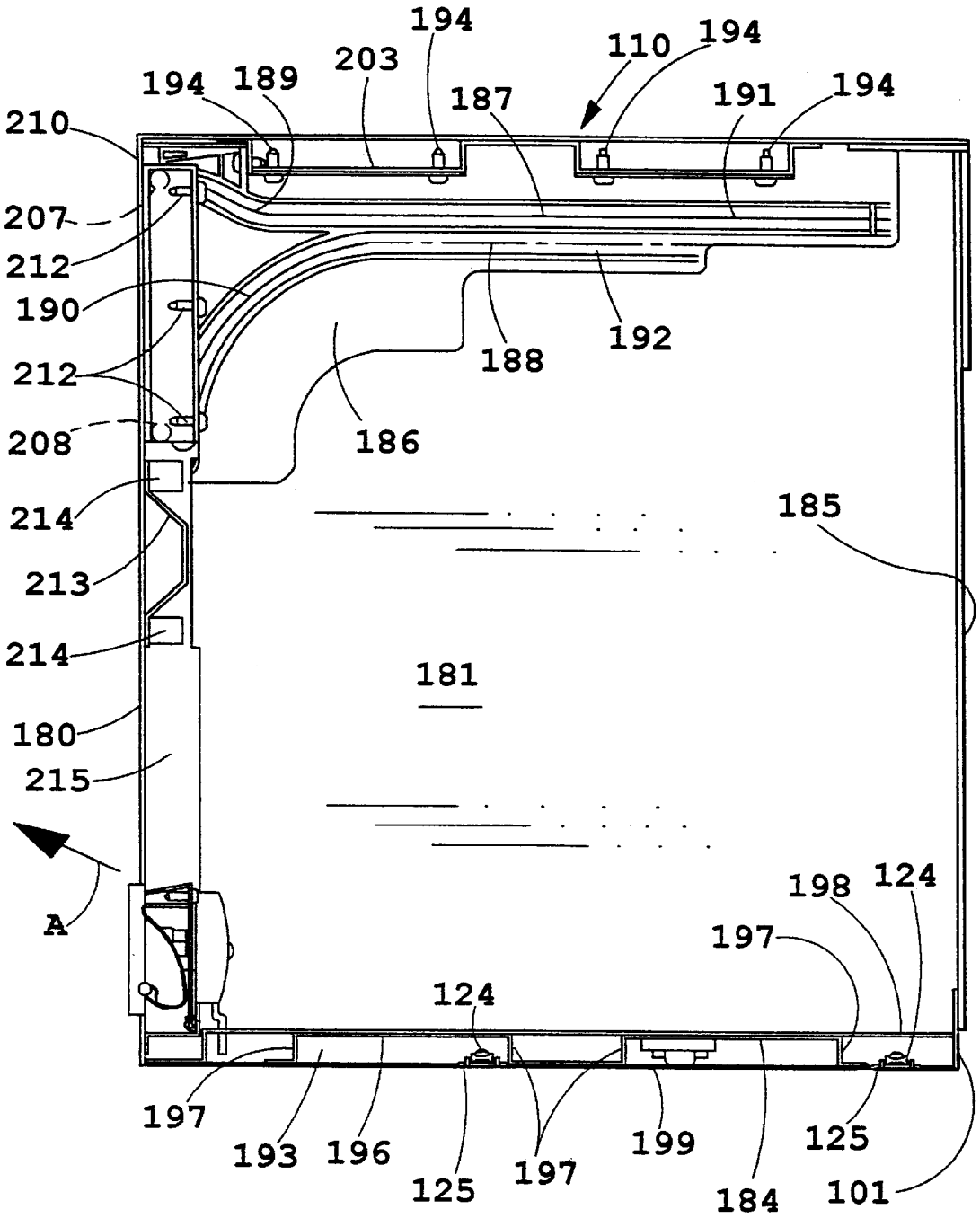
FIG. 30 is a side elevational view of a first embodiment of the storage bin of FIG. 1 with a sidewall removed to show the Y-shaped track.

The blades 7 and hangers 90 may also be used to support a storage bin 110 (FIG. 29). The storage bin 110 includes a door 180 and a pair of opposing side walls 181 and 182, a top wall 183 and a bottom wall or shelf 184. The bin 110 also includes a rear wall 185. As best seen in FIG. 30, the storage bin 110 includes a pair of indented, notched side edge portions 125 along each opposite side edge of bottom wall 184 that receive receptacles 124. A pair of slots 101 are located at the lower corners of the rear wall 185, and in combination with the receptacles 124, removably connect or lock the storage bin 110 to the hangers 90 and blades 7 in substantially the same manner as described above for the shelf 20. A channel 196 includes four vertical walls 197 and extends between walls 184 and 199 of bin 110 to provide additional structural support.

Figure 37:
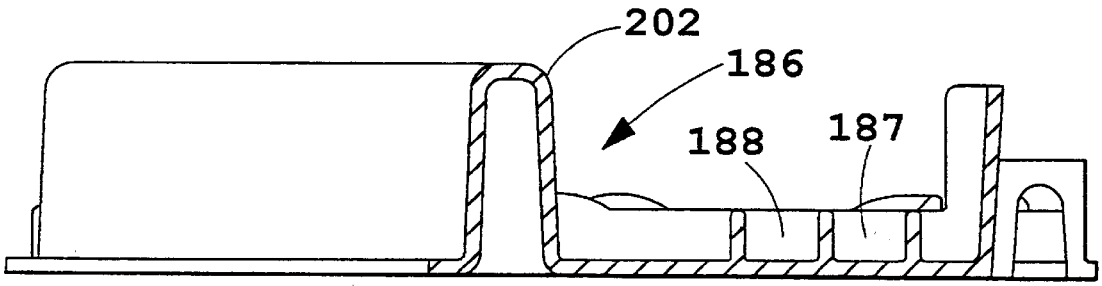
FIG. 37 is a cross-sectional view of the Y-shaped track taken along the line XXXVII of FIG. 35.

Y-shaped track 186 of the first embodiment of bin 110 includes an upper track 187 and a lower track 188, each of which form a guide for opening and closing the door 180 (FIG. 30). The right hand track is a mirror image of the left hand track 186 and will not be further described herein. Upper track 187 and lower track 188 include horizontal portions 191 and 192 that are parallel, and in close proximity to one another. Upper track 187 includes an upper leg 189 that terminates in an approximately horizontal portion 200 adjacent the forward edge of the bin 110. Lower track 188 includes a lower leg 190 that extends downwardly forming an approximately quarter-circular shape and terminating at an approximately vertical portion 201. Track 186 is preferably molded from a polymer material such as acetal. The track 186 is secured to the bin by fasteners 194. Tracks 187 and 188 each have an inwardly-opening U-shaped cross section (FIG. 37). Track 186 includes a structural brace 202 adjacent the forward lower edge.

Figure 33:
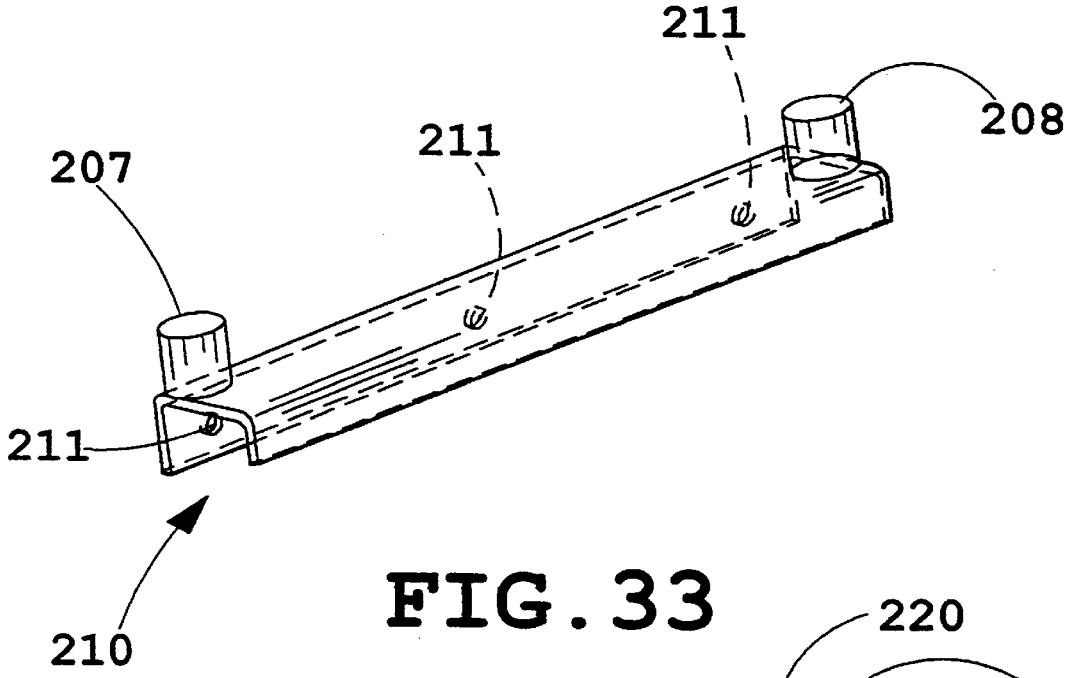
FIG. 33 is a perspective view of a guide bracket assembly for a metal storage bin door.
Figure 34:
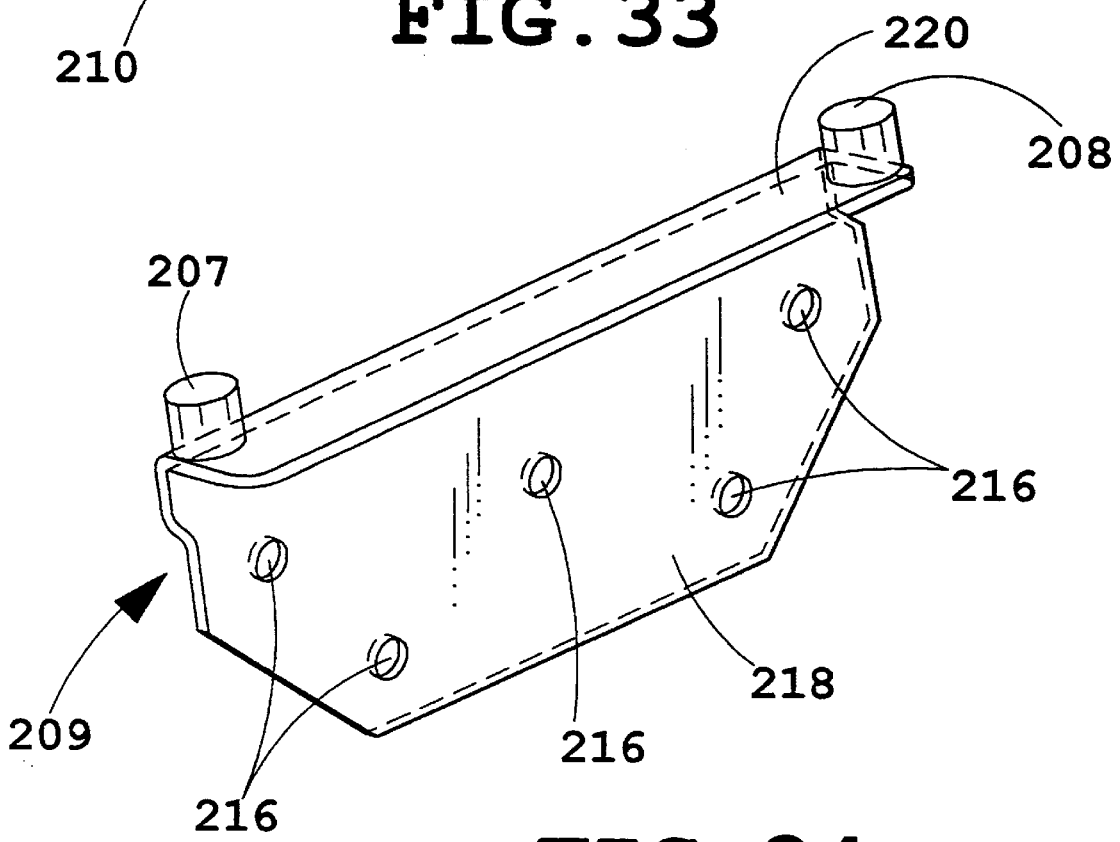
FIG. 34 is a perspective view of a guide bracket assembly for a wood storage bin door.
Figure 35:
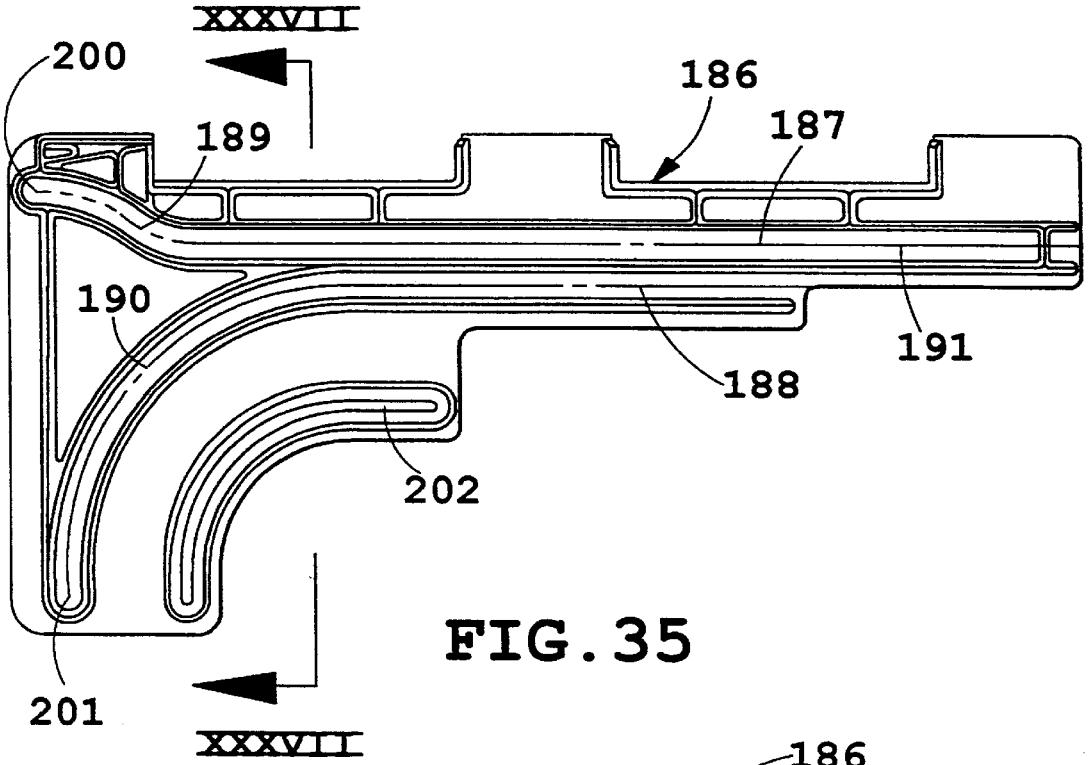
FIG. 35 is a top elevational view of the Y-shaped track of FIG. 30.
Figure 36:
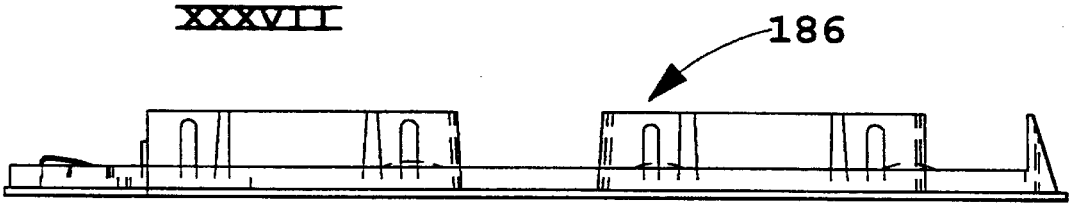
FIG. 36 is a side elevational view of the Y-shaped track of FIG. 30.

With reference to FIGS. 31–34, each door 180 includes a handle 205 and a lock 206. The door 180 illustrated in FIG. 30 is made from sheet metal. The wood door 179 illustrated in FIGS. 31 and 32 has substantially the same functions. However, a wood material is used for aesthetic purposes. The doors 179 and 180 each have a pair of upper and lower cylindrical protrusions or pins 207 and 208, respectively. The upper protrusion 207 engages the upper track 187, and the lower cylindrical protrusion 208 engages the lower track 188 of the Y-shaped track 186. Protrusions 207 and 208 are spaced-apart, and provide an anti-racking function, such that an equalizer assembly is not required. In a preferred embodiment, the protrusions 207 and 208 are spaced-apart about four inches to act as an equalizer. Smaller dimensions, such as two inches, or three inches, or larger dimensions, such as five inches or six inches, are also functional, and provide an anti-racking feature, but are less preferred than the four inch dimension. A bracket assembly 209 is used with the wood door 179, and a similar bracket assembly 210 is used with the metal door 180 (FIGS. 33, 34). The "left hand" guide brackets (not shown) are mirror images of the "right hand" guide brackets illustrated in FIGS. 33 and 34.

With reference to FIGS. 30 and 33, the metal door guide bracket assembly 210 has a generally U-shaped cross-sectional shape with cylindrical protrusions 207 and 208 being welded thereto along the base of the U-shape. Three holes 211 along a leg of the U-shape provide clearance for screws 212 which attach the bracket 210 along opposite side edges of the sheet metal door 180. The sheet metal door 180 includes a pair of inwardly-extending flanges 215. A generally hat-shaped channel 213 extends across the door and is bonded thereto. Channel 213 is spot welded to the flanges 215 at tabs 214.

Figures 31, 32:
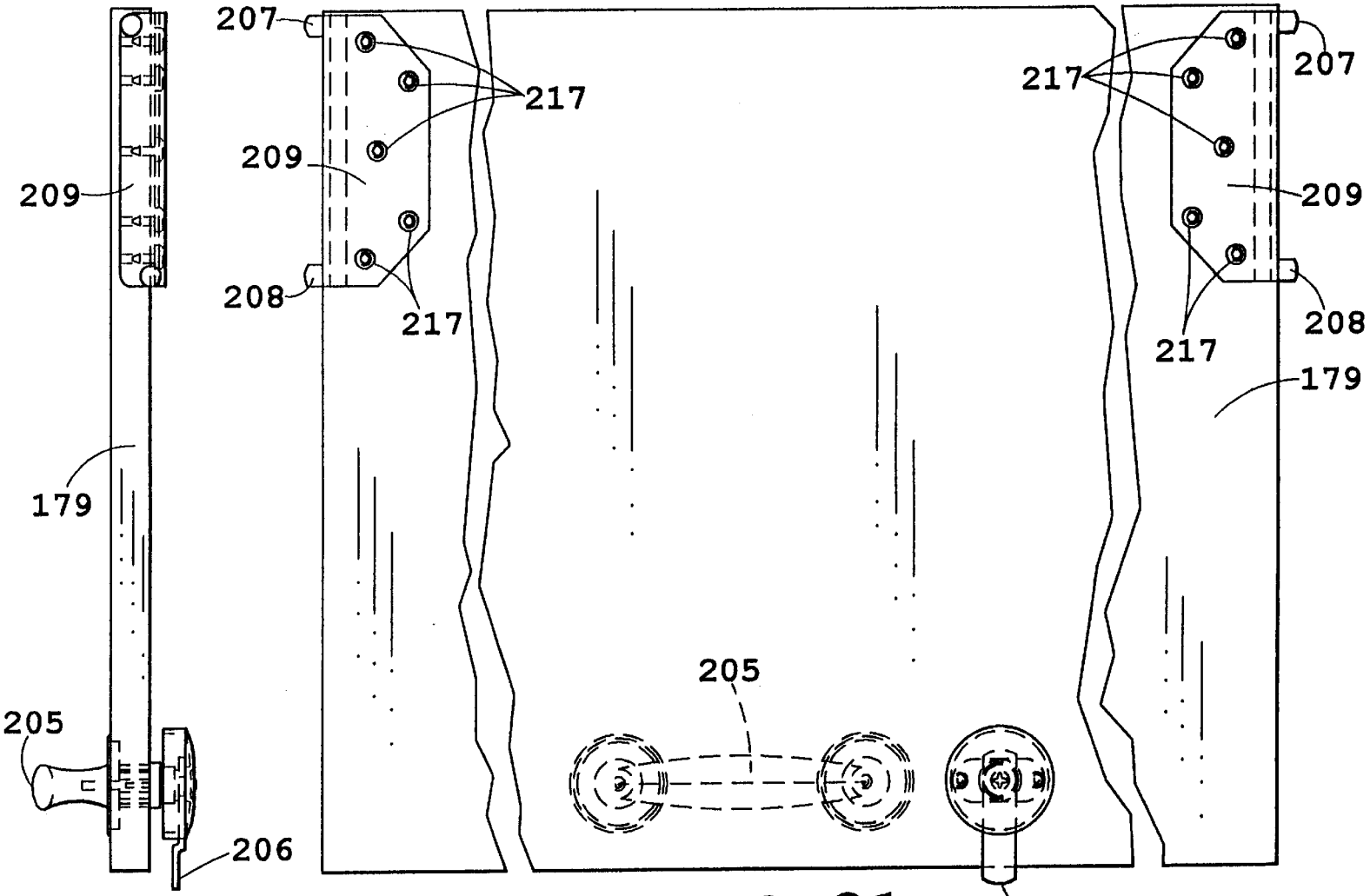
FIG. 31 is a fragmentary view of the storage bin door of FIG. 1.
FIG. 32 is a side elevational view of the storage bin door of FIG. 30.

With reference to FIGS. 31, 32 and 34, the wood door guide bracket assembly 209 includes clearance holes 216 in the flange 218 that provide clearance for wood screws 217 (FIG. 31).

Both the wood door 179 and the metal door 180 are guided in the upper and lower tracks 187 and 188 during opening and closing of the door such that when moving the door from the closed position to the open position (arrow "A", FIG. 30) the door first rotates and then begins to translate rearwardly as the door approaches the flat horizontal position. The door is then translated rearwardly along the horizontal portions 191 and 192 of the upper and lower tracks 187 and 188, respectively.

Figure 38:
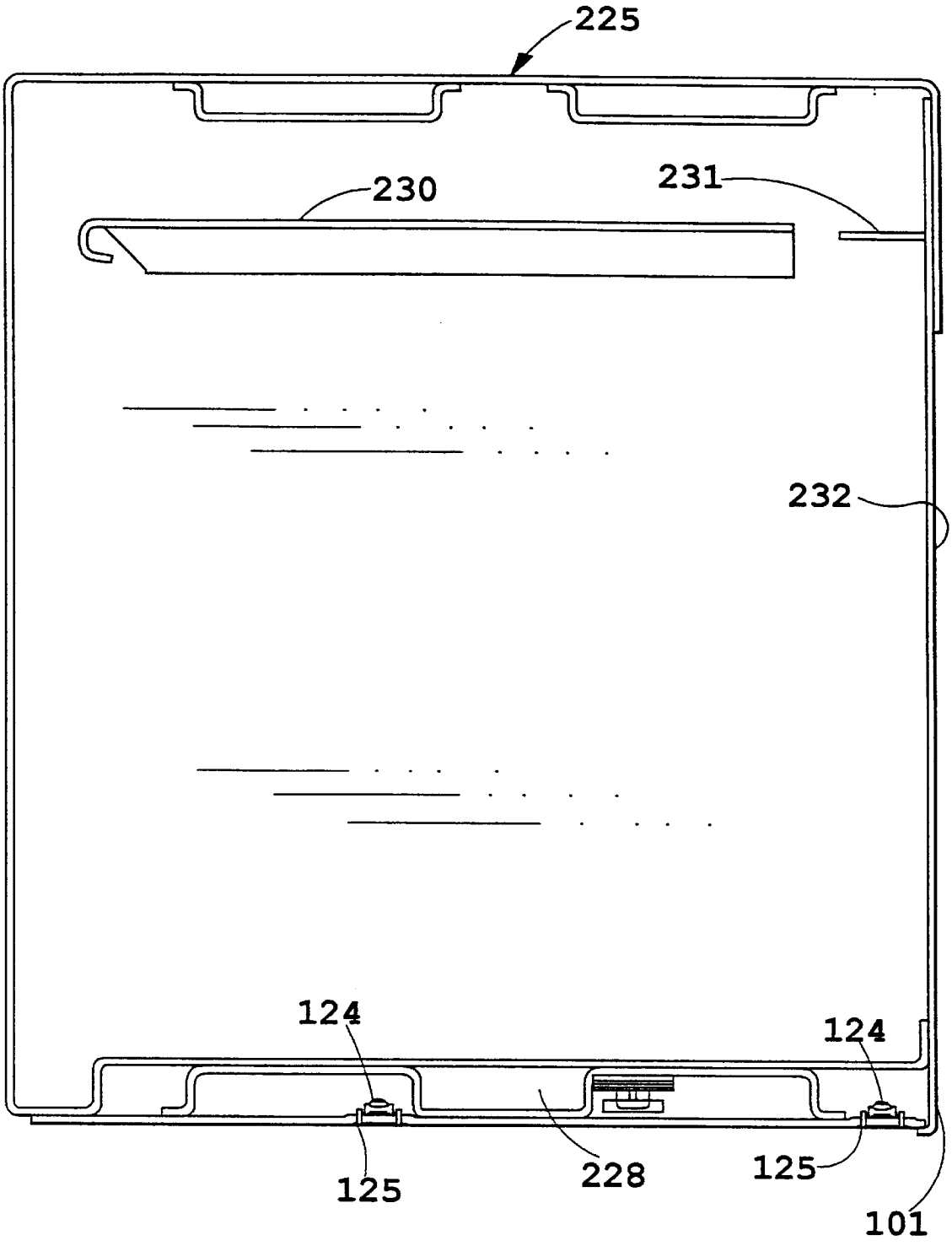
FIG. 38 is a side elevational view of a second embodiment of the storage bin of FIG. 1 having a scissors-type equalizer assembly for the bin door.
Figure 39:
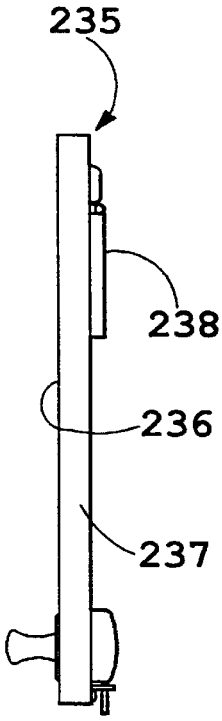
FIG. 39 is a side elevational view of the bin door for the second embodiment of the storage bin of FIG. 1.
Figure 40:
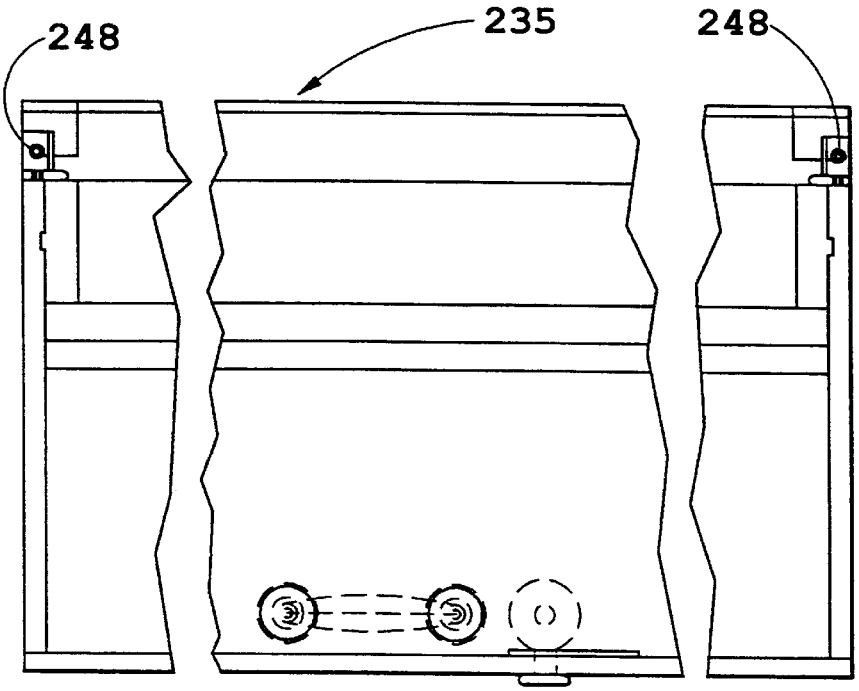
FIG. 40 is a fragmentary front elevational view of the bin door for the second embodiment of the storage bin of FIG. 1.

A second embodiment 225 of the bin is illustrated in FIG. 38. Bin 225 is similar to the first embodiment discussed above, except that a scissors-type equalizer 229 (FIG. 41) is utilized to prevent racking instead of the Y-shaped track 186. The bin 225 includes a pair of notched, indented side edge portions 125 along each opposite side edge of bottom wall 199, each of which receives a receptacle 124 to removably attach bin 225 to a pair of blades 7 in substantially the same manner as shelf 20 and bin 110. A horizontal side flange 230 extends inwardly from each sidewall of the bin 225 for support of the door 235 (FIG. 39, 40) when the door 235 is in the closed position. A horizontal rear flange 231 extends along the rear wall 232 of the bin 225. With reference to FIG. 39 and 40, the door 235 is made from sheet metal, and includes a front wall 236 and flanges 237 that extend inwardly. A hat-shaped brace 238 is welded or bonded to the inner side of the wall 236 to strengthen the door 235.

Figure 41:
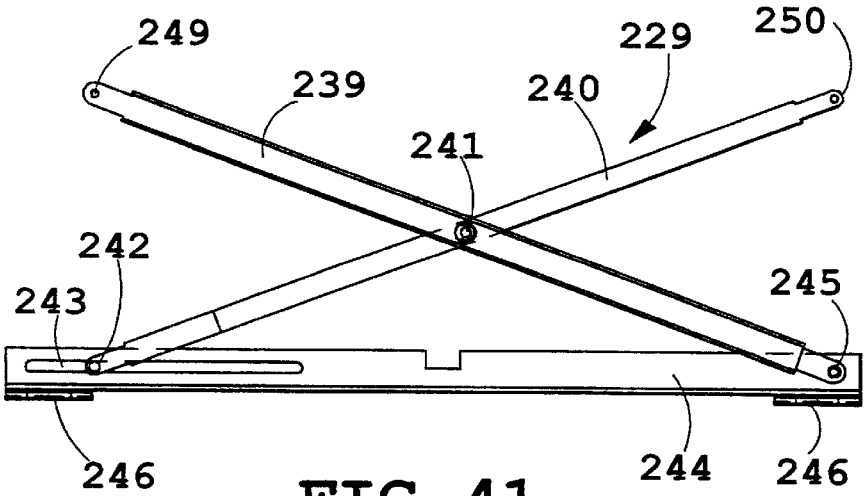
FIG. 41 is a front elevational view of the equalizer assembly for the second embodiment of the storage bin of FIG. 1.
Figure 42:
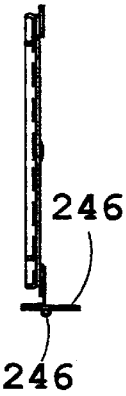
FIG. 42 is side elevational view of the equalizer assembly for the second embodiment of the storage bin of FIG. 1.

With reference to FIGS. 41 and 42, the equalizer assembly 229 includes first and second elongated flat members 239 and 240 that are pivotally connected at 241. The second member 240 is slidably connected to a base member 244 at slot 243. The first member 239 is pivotally connected to the base member 244 at 245. A pair of hinges 246 are mounted to the base 244, and include a flat plate 247 that is fixed to the door 235 at 248. A slot (not shown) in the rear flange 231 is slidably connected to the first member 239 at 249, and the second member 240 is pivotally connected to the rear flange 231 at 250. The hinges 246 and the equalizer assembly 229 cooperate to permit the door 235 to be pivoted upward to a horizontal, open position and then slid rearwardly to a position where the door 235 is supported on the horizontal side flanges 230.

In the foregoing description, it will be readily appreciated by those skilled in the art that modifications may be made to the invention without departing from the concepts disclosed herein. Such modifications are to be considered as included in the following claims, unless these claims by their language expressly state otherwise.

We claim:

1. A partition panel system comprising:

a partition frame with vertically spaced horizontal frame members defining a horizontal row of first discrete attachment locations;

a pair of horizontally spaced blades releasably attached to selected ones of said first discrete attachment locations, said blades including opposing inner surfaces defining vertically spaced second discrete attachment locations;

at least one shelf releasably attached to selected ones of said second discrete attachment locations; whereby the at least one shelf is horizontally and vertically adjustably supported on said partition frame in a selected one of a variety of different discrete positions.

2. The partition panel system defined in claim 1, wherein each of the blades includes a safety catch that is movable between a locked position wherein said safety catch engages a selected one of said horizontal frame members preventing removal therefrom, and an unlocked position allowing detachment of said blades from said horizontal frame member.

3. The partition panel system defined in claim 2, wherein said first discrete attachment locations comprise a horizontal row of slots in each of said horizontal frame members, and each of said blades include rear protrusions that are engageable with at least a selected one of said slots in said horizontal frame member to releasably attach said blades to said partition frame.

4. The partition panel system defined in claim 3, wherein said blades each comprise a vertically elongated upright attachment member and a corresponding upright side wall, said upright attachment member including said rear protrusions on a rearward side of said upright, and including front protrusions on a forward side of said upright;

said upright side wall having openings along a vertical rearward edge thereof that removably engage said front protrusions of a corresponding upright to thereby removably attach said side wall to said corresponding upright.

5. The partition panel system defined in claim 4, wherein said side wall includes a second safety catch that is movable between a locked position wherein said second safety catch engages said upright attachment member preventing removal therefrom, and an unlocked position allowing detachment of said side wall from said upright attachment member.

6. The partition panel system defined in claim 5, wherein said side wall has a passageway forming an opening adjacent said rearward edge of said side wall, and forming an opening adjacent at least a selected one of said second discrete attachment locations to allow routing of power and communications lines from said partition panel to said shelves through said passageway.

7. The partition panel system defined in claim 1, wherein said second discrete attachment locations comprise at least one vertical row of slots on said opposing inner surfaces of said blades, said shelves defining opposite side edges, each having protrusions that engage said slots in said blades to releasably attach said shelves to said blades.

8. The partition panel system defined in claim 7, wherein said shelf includes shelf locks adjacent each opposite side edge, each shelf lock movable between a locked position engaging a blade to lock said shelf to said blade, and an unlocked position wherein said shelf lock is disengaged from said blade to permit detachment of said shelf from said blade.

9. The partition panel system defined in claim 8, wherein said partition panel system includes hangers defining said protrusions on said shelf side edges, each hanger having an L-shaped support flange, said L-shaped support flange defining horizontally and vertically-extending legs engaging a side edge of said shelf for support thereof, said horizontal leg of said L-shaped support flange being configured to receive a quick-connector to thereby lock said shelves to said hangers.

10. The partition panel system defined in claim 9, wherein said hangers are formed from sheet metal and said protrusions on said hanger extend perpendicularly from opposite ends of said vertical leg of said L-shaped flange, each of said protrusions including an upwardly-extending hook that opens transversely inwardly, said hooks being insertable and rotatable to an installed position in said slots in said blades such that said vertical leg contacts said inner surface of said blade when in the installed position.

11. The partition panel system defined in claim 1, wherein said shelf defines a bottom wall of a bin, said bin including a pair of side walls and a top wall;

said top, bottom and side walls defining front edges that form a substantially rectangular front opening of said bin, said bin including a door and a pair of guides operably interconnecting said door and said bin for guided movement between an open position away from said front opening and a closed position covering at least a portion of said front opening.

12. The partition panel system defined in claim 11, wherein said guides each include upper and lower tracks fixed to inner surfaces of said side walls, said tracks forming a transversely-oriented Y-shaped section, said upper track forming an upper leg of said Y-shape, and said lower track forming a lower leg of said Y-shaped section with parallel, adjacent portions of said upper and lower tracks forming a base portion of said Y-shaped, said door defining upper and lower edges and a pair of side edges, each side edge including spaced-apart upper and lower guide-engaging members that slidably engage said upper and lower tracks, respectively, such that said lower edge of said door rotates upwardly and said door simultaneously translates rearwardly when moving from said closed position to said open position.

13. The partition panel system defined in claim 10, wherein said second discrete attachment locations comprise at least one vertical row of slots on said opposing inner surfaces of said blades, said shelves defining opposite side edges, each having protrusions that engage said slots in said blades to releasably attach said shelves to said blades.

14. The partition panel system defined in claim 13, wherein said shelves each include shelf locks adjacent each opposite side edge, each shelf lock movable between a locked position engaging a blade to lock said shelf to said blade, and an unlocked position wherein said shelf lock is disengaged from said blade to permit detachment of said shelves from said blades.

15. The partition panel system defined in claim 14, wherein the protrusions are defined by hangers that include a L-shaped flange defining horizontal and vertical legs, the horizontal leg engaging an associated side edge of the shelf for support thereof, the horizontal leg of the L-shaped flange being configured to receive a quick-connector that removably locks said shelves to said hangers.

16. The partition panel system defined in claim 15, wherein said hangers are formed from sheet metal and said protrusions on said hanger extend perpendicularly from opposite ends of said vertical leg of said L-shaped flange, each protrusion including an upwardly-extending hook that is insertable and rotatable to an installed position in the slots in the blades such that said vertical leg contacts said inner surface of said blade when in the installed position.

17. The partition panel system defined in claim 16, wherein said shelf defines a bottom wall of a bin, said bin including a pair of side walls and a top wall;

said top, bottom and side walls defining front edges that form a substantially rectangular front opening of said bin, said bin including a door and a pair of guides operably interconnecting said door and said bin for guided movement between an open position away from said front opening and a closed position covering at least a portion of said front opening.

18. The partition panel system defined in claim 17, wherein said guides each include upper and lower tracks fixed to inner surfaces of said side walls, said tracks forming a transversely-oriented Y-shaped section, the upper track forming an upper leg of said Y-shaped section, and said lower track forming a lower leg of said Y-shaped section with parallel, adjacent portions of said upper and lower tracks forming a base portion of said Y-shaped section, said door defining upper and lower edges and a pair of side edges, each side edge including spaced-apart upper and lower guide-engaging members that slidably engage said upper and lower tracks, respectively, such that said lower edge of said door rotates upwardly and said door simultaneously translates rearwardly when moving from said closed position to said open position.

19. The partition panel system defined in claim 18, wherein said upper and lower tracks comprise U-shaped channels, and wherein said guide-engaging members comprise cylindrical protrusions that are received with said U-shaped channels for sliding engagement therewith.

20. A partition panel system comprising:

a partition panel;

a pair of horizontally spaced-apart upright blades defining front edges away from said partition panel, said blades attached to a front of said partition panel; and a plurality of shelves defining side edges, said shelves being attached between said blades, at least one shelf having a front portion with side edges that extend partially around said front edges of said blades.

21. The partition panel system defined in claim 20, wherein each of said blades defines an opposing inner surface and outer surface on an opposite side thereof and a blade thickness therebetween, said inner and outer surfaces of said blades having a curved shape such that the blade thickness decreases adjacent said front edges of said blades, said side edges of said front portion of said at least one shelf each having a shape corresponding to a corresponding inner surface of said blades.

22. The partition panel system defined in claim 21, wherein said inner and outer surfaces of said blades include planar portions defining a vertical center plane therebetween, said inner and outer surfaces of said front edges of said blades defining an elliptical cross-sectional shape, the major axis of the ellipse being coincident with a center plane of said blades, said side edges of said front portion of said at least one shelf having an elliptical curved shape corresponding to said blade and in close alignment therewith.

23. The partition panel system defined in claim 22, wherein said blades are made from sheet metal that is bent in a curved manner to form the elliptical cross-sectional shape of said front edge of said blades, thereby forming a cavity within said blade.

24. The partition panel system defined in claim 23, wherein said inner surfaces of said blades include a vertical row of second discrete attachment locations, said at least one shelf being releasably attachable to said blades at said discrete attachment locations to provide vertical adjustment of said shelf.

25. The partition panel system defined in claim 24, wherein said second discrete attachment locations comprise slots, said at least one shelf defining opposite side edges with protrusions that engage said slots to releasably attach said at least one shelf to said blades.

26. The partition panel system defined in claim 25, wherein said at least one shelf includes a shelf lock adjacent each side edge of said shelf, said shelf lock movable between an unlocked position permitting detachment of said shelf from said blades, and a locked position wherein said shelf is locked to said blades.

27. The partition panel system defined in claim 26, wherein said partition panel includes vertically spaced horizontal frame members defining a horizontal row of first discrete attachment locations, said blades being releasably attached to said first discrete attachment locations to thereby provide horizontal adjustment of said shelves.

28. The partition panel system defined in claim 27, wherein said first discrete attachment locations comprise slots in said horizontal frame members, and wherein said blades include upper hooked portions adjacent an upper end, and lower hooked portions adjacent a lower end of said blades, said upper and lower hooked portions releasably engaging said slots in said horizontal frame members.

29. The partition panel system defined in claim 28, wherein said blades comprise a vertically elongated upright attachment member and a corresponding upright side wall, said upper and lower hooked portions being located along a rear edge of said upright attachment member adjacent upper and lower ends thereof, said vertical spacing between said upper and lower hooked portions being adjustable, said upright including forward hooks along a forward edge of said upright, said blades including openings along a vertical rear edge that releasably engage said forward hooks.

30. A partition panel system comprising:

a partition panel;

a pair of horizontally spaced blades attached to a front of said partition panel and having opposing inner surfaces;

shelf inner supports on said opposing inner surfaces of said blades;

a shelf with ends engaging said shelf inner supports; and shelf locks on said ends movable between locked and unlocked positions, said locks when in said locked position securing said shelf to the shelf supports and preventing said shelf supports from being dislodged from said blades.

31. The partition panel system defined in claim 30, wherein each shelf lock comprises a quick-connector.

32. The partition panel system defined in claim 31, wherein said shelf supports comprise a vertical row of openings on said inner surfaces of said blades.

33. The partition panel system defined in claim 32, wherein each of said shelves include a pair of hangers, each having a support flange extending along an inner side thereof for supportive releasable engagement with an end of said shelf, said hanger defining protrusions extending from an outer side thereof that are configured for releasable engagement with said openings in said blades.

34. The partition panel system defined in claim 33, wherein said support flange has an L-shape with a vertical leg and a horizontal leg, the horizontal leg configured to receive said quick-connector to secure the shelf to the blades.

35. The partition panel system defined in claim 34, wherein said protrusions on said hangers extend perpendicularly from said vertical leg of said support flange and include an upwardly-extending U-shaped hook portion, such that said hanger is removably attached to said blades by insertion of said hook portion in said slots followed by downward rotation of said hanger to bring said vertical leg into abutting contact with said inner surfaces of said blades.

36. The partition panel system defined in claim 35, wherein said quick-connector comprises a one-half-turn fastener.

37. The partition panel system defined in claim 36, wherein said partition panel includes a panel frame with a pair of vertically-spaced horizontal members, each having a horizontal row of slots therein, said blades including vertically spaced-apart upper and lower hooked portions that are configured to releasably engage selected ones of the slots.

38. The partition panel system defined in claim 37, wherein said blades include antidislodgement brackets movable between locked and unlocked positions, the antidislodgement brackets when in the locked position securing the blades to the horizontal frame members.

39. The partition panel system defined in claim 38, wherein said vertical spacing between said upper and lower hooked portions is adjustable to account for variations in the distance between said horizontal rows of slots in said horizontal members.

40. A partition panel system comprising:

a partition panel having vertically spaced-apart horizontal frame members defining horizontally-spaced discrete attachment locations;

a pair of horizontally spaced-apart blades having upper and lower ends configured to securely engage said vertically spaced-apart horizontal frame members of said partition panel at selected ones of said horizontally spaced discrete attachment locations, at least one of said upper and lower ends being vertically adjustable relative to the other of the upper and lower ends;

a shelf attached between the blades; and antidislodgement brackets on said blades movable between locked and unlocked positions, said antidislodgement brackets when in said locked position securing said blades to said horizontal frame members, said blades and shelf attachable to said partition panel in a selected location optimally suited for particular circumstances of use.

41. The partition panel defined in claim 40, wherein said horizontally-spaced discrete attachment locations comprise a horizontal row of slots in each of said horizontal frame members, said blades including vertically spaced-apart hooked portions, each of which releasably engages selected ones of said slots.

42. The partition panel defined in claim 41, wherein said antidislodgement brackets are slidably mounted to said blades adjacent the upper hooked portions and include a protruding portion that engages a selected one of said slots, preventing movement of said blades relative to said horizontal frame members to thereby lock said hooks into engagement with said slots.

43. The partition panel defined in claim 42, wherein said lower hooked portions are adjustably attached to said blades by a threaded member to allow adjustment of the vertical spacing between said upper and lower hooked portions.

44. The partition panel system defined in claim 43, wherein said shelf defines a bottom wall of a bin, said bin including a pair of side walls and a top wall;

said top, bottom and side walls defining front edges that form a substantially rectangular front opening of said bin, said bin including a door and a pair of guides operably interconnecting said door and said bin for guided movement between an open position away from said front opening and a closed position covering at least a portion of said front opening.

45. The partition panel defined in claim 44, wherein each of said side walls have a bottom edge, and wherein said blades define inner and outer surfaces, said partition panel system including a pair of hangers releasably attaching said bin to said blades, each hanger including an L-shaped support flange and a forwardly-extending tab, said bin further including a slot that receives said tab.

46. The partition panel defined in claim 45, wherein said support flange of said hanger is configured to receive a quick-connector that locks the bin to the hangers.

47. The partition panel defined in claim 40, wherein said blades include an interior passageway forming a first opening adjacent a shelf, and a second opening adjacent a horizontal frame member for routing of communications and power cables therebetween.

48. The partition panel defined in claim 47, wherein said blades are formed from sheet metal that is bent to form a curved forward edge and having substantially parallel inner and outer planar portions defining inner and outer surfaces, respectively, of said blades and defining a substantially open interior forming said passageway, said blades including at least one brace within said open interior rigidly interconnecting said inner and outer planar portions at a location that is spaced-apart from said curved forward edge.

49. The partition panel defined in claim 48, wherein said shelf has a pair of side edges and includes a front portion and a rear portion, said front portion being located further away from said partition than said rear portion, said side edges tapering outwardly adjacent said front portion such that said front portion is wider than said rear portion and extends around said curved forward edge of said blades.

50. A partition panel system comprising:

a partition panel; and a binder bin configured for attachment to said partition panel, said binder bin including:

opposing side walls with inner surfaces, and a top wall and a bottom wall extending between said side walls to define an enclosable cavity with an opening;

opposing molded track members attached to said inner surfaces of said opposing side walls, said track members each defining a pair of integrally-formed guides; and a door with a bottom edge and opposite ends each including a pair of guide-engaging members, each slidably engaging a selected one of said guides, said guides being configured to guide the opening and closing of said door so that when said door is opened a bottom of said door pivots initially outwardly and upwardly, and then said door slides under said top panel.

51. The partition panel defined in claim 50, wherein said tracks include upper and lower guides forming a horizontally oriented Y-shaped section with said legs of the Y-shaped section opening towards said opening of said binder bin, and wherein said upper guide forms an upper leg of said Y-shaped section, and said lower guide forms a lower leg of said Y-shaped section, said upper and lower guides having parallel horizontal portions that form a horizontal base portion of said Y-shaped section.

52. The partition panel defined in claim 51, wherein said guides have a generally U-shaped cross section, and said guide-engaging members on said doors comprise protrusions that are spaced-apart to prevent racking and are slidably received within said U-shape for guided movement therealong.

53. The partition panel defined in claim 52, wherein said lower leg has an approximately vertical portion at an end opposite the horizontal base portion with a curved portion forming an approximately quarter-circular curved section extending between the horizontal base portion and said opposite end.

54. The partition panel defined in claim 53, wherein said upper leg formed by said upper guide has an approximately horizontal portion at an end opposite said horizontal base portion.

55. The partition panel defined in claim 54, wherein said track members are molded from a polymeric material.

56. The partition panel system defined in claim 50 wherein said partition panel has vertically spaced horizontal frame members defining horizontally spaced discrete attachment locations, and wherein said binder bin is releasably attached to selected ones of said horizontally spaced discrete attachment locations.

57. The partition panel defined in claim 56, wherein said tracks include upper and lower guides forming a horizontally oriented Y-shaped section with legs of the Y-shaped section opening towards the opening of the binder bin, wherein said upper guide forms an upper leg of said Y-shaped section, and said lower guide forms a lower leg of said Y-shaped section, said upper and lower guides having parallel horizontal portions forming a base portion of said Y-shaped section.

58. The partition panel defined in claim 57, wherein said guides have a generally U-shaped cross section, and said guide-engaging members on said doors comprise protrusions that are spaced-apart to prevent racking and are slidably received within said U-shape for guided movement therealong.

59. The partition panel defined in claim 56, wherein said horizontally-spaced discrete attachment locations comprise a horizontal row of slots in said horizontal frame member, and wherein said bin includes upper and lower hooked portions releasably attached to selected ones of said slots.

60. The partition panel defined in claim 59, wherein said binder bin includes an antidislodgement bracket that is movably mounted adjacent said upper hooked portion and movable between a locked position wherein a portion of said antidislodgement bracket is received within a slot preventing disengagement of said upper hooked portion from said slots, and an unlocked position wherein said upper hooked portion is removable from said slots.

61. The partition panel defined in claim 60, wherein said partition panel includes a pair of horizontally spaced-apart blades with opposing inner sides, said binder bin being releasably attached to said inner sides of said blades.

62. The partition panel defined in claim 61, wherein said blades each have discrete attachment locations on said inner sides, said binder bin including protrusions that engage said discrete attachment locations.

63. A partition panel system for offices and the like, comprising:

at least two substantially planar partition panels defining orthogonal front surfaces, said panels being joined along a vertical junction;

a vertically elongated corner support member aligned with, and adjacent to, said vertical junction and attached to at least one of said partition panels, said corner support member having a tubular cross-sectional shape with a front face and a rear face with a first vertical row of slots in said front face and a second vertical row of slots in said rear face;

a corner shelf defining upper and lower surfaces and a rear edge with at least two substantially straight portions orthogonal to one another and configured to align with said front surfaces of said partition panels in close proximity thereto, said corner shelf including a support member adjacent said rear edge, said support having an extension engaging a selected one of said slots in said front face and also engaging a selected one of said slots in said rear face to removably support said corner shelf on said partition panel system.

64. The partition panel system for offices according to claim 63, wherein said partition panel system includes a pair of blades with front and rear edges, said blades being removably attached to said partition panels, and wherein said corner shelf defines opposite side edges, each having a front portion extending around said front edges of said blades.

65. The partition panel system for offices according to claim 63, wherein said partition panels each include vertically spaced-apart horizontal members defining horizontally spaced discrete attachment locations thereon, said blades being removably attached to selected ones of said horizontally spaced discrete attachment locations.

66. The partition panel system for offices according to claim 65, wherein said horizontally spaced discrete attachment locations comprise slots in said horizontal members, and wherein said blades include upper and lower hooked portions, each of said blades including an antidislodgement bracket movable between an unlocked position and a locked position, in the locked position a portion of said safety catch being received within a selected one of said slots, thereby preventing accidental dislodgement of said blade from the horizontal members.

67. The partition panel system for offices, comprising:

at least two substantially planar partition panels defining orthogonal front surfaces, said panels being joined at a vertical junction, and including a partition frame with vertically spaced-apart horizontal members defining horizontally spaced first discrete attachment locations thereon;

a pair of horizontally spaced blades releasably attached to selected ones of said first discrete attachment locations, said blades including opposing inner surfaces;

a corner shelf with opposite ends that are each releasably attached to a selected one of said opposing inner surfaces.

68. The partition panel system for offices according to claim 67, wherein said opposing inner surfaces of said blades define vertically spaced second discrete attachment locations whereby said corner shelf is vertically adjustably supported on said partition frame.

69. The partition panel system for offices according to claim 68, wherein said first discrete attachment locations comprise slots in said horizontal members, said blades including upper and lower hooked portions engaging selected ones of said slots in said horizontal members, and wherein said second discrete attachment locations comprise slots in said opposing inner surfaces, said opposite ends of said corner shelf having protrusions releasably attaching said corner shelf to said blades.

* * * * *